US009302821B2

(12) United States Patent
Wehrmann

(10) Patent No.: US 9,302,821 B2
(45) Date of Patent: Apr. 5, 2016

(54) RECLOSABLE BAG AND METHODS OF FORMING AND USING SAME

(71) Applicant: Automated Packaging Systems, Streetsboro, OH (US)

(72) Inventor: Rick Steven Wehrmann, Hudson, OH (US)

(73) Assignee: Automated Packaging Systems, Streetsboro, OH (US)

( * ) Notice: Subject to any disclaimer, the term of this patent is extended or adjusted under 35 U.S.C. 154(b) by 0 days.

(21) Appl. No.: 13/832,813

(22) Filed: Mar. 15, 2013

(65) Prior Publication Data

US 2013/0308883 A1 Nov. 21, 2013

Related U.S. Application Data

(60) Provisional application No. 61/646,947, filed on May 15, 2012, provisional application No. 61/677,685, filed on Jul. 31, 2012.

(51) Int. Cl.
*B65D 33/16* (2006.01)
*B65D 33/20* (2006.01)
(Continued)

(52) U.S. Cl.
CPC . *B65D 33/20* (2013.01); *B31B 1/00* (2013.01); *B65D 75/5827* (2013.01); *B31B 2219/6007* (2013.01); *B31B 2219/9012* (2013.01); *B31B 2237/10* (2013.01); *B31B 2237/406* (2013.01); *B65D 2575/586* (2013.01)

(58) Field of Classification Search
CPC ... B65D 33/20; B65D 2575/586; B65D 33/18
USPC ..... 383/62, 203, 66, 204, 86, 211
See application file for complete search history.

(56) References Cited

U.S. PATENT DOCUMENTS 2,777,631 A 1/1957 Zalkind
3,184,149 A * 5/1965 Repko ..... 383/203
(Continued)

FOREIGN PATENT DOCUMENTS

JP 2008-013190 1/2008
JP 2009-292494 12/2009
(Continued)

OTHER PUBLICATIONS

International Search Report and Written Opinion from PCT/US13/040834 dated Sep. 12, 2013.

*Primary Examiner* — Jes F Pascua
(74) *Attorney, Agent, or Firm* — Calfee, Halter & Griswold LLP

(57) ABSTRACT

An exemplary reclosable bag includes a first ply joined to a second ply to define a main bag portion having a compartment and a product receiving opening. A reclosing flap is connected to the main bag portion and is spaced apart from the product receiving opening. A reclosing material and a release material are applied to the bag and are arranged such that the reclosing material releasably adheres to the release material. The reclosing flap is movable between a passive position and an active position. A bag opening zone formed in the main bag portion proximate the reclosing flap may be opened to create a product retrieval opening for retrieving a product from the compartment. The product is returned to the compartment through the product retrieval opening, and the compartment is reclosed by moving the reclosing flap from the passive position to the active position.

20 Claims, 31 Drawing Sheets

(51) Int. Cl.
*B65D 75/58* (2006.01)
*B31B 1/00* (2006.01)

(56) References Cited

U.S. PATENT DOCUMENTS

| | | | | | |
|---|---|---|---|---|---|
| 3,276,669 | A | * | 10/1966 | Vilutis | 383/204 |
| 3,387,640 | A | * | 6/1968 | Butler | 206/260 |
| 3,388,789 | A | * | 6/1968 | Simandl et al. | 383/203 |
| 4,192,420 | A | * | 3/1980 | Worrell et al. | 206/205 |
| 4,428,477 | A | * | 1/1984 | Cristofolo | 206/210 |
| 4,483,018 | A | | 11/1984 | Whelan | |
| 4,629,071 | A | * | 12/1986 | Tani | 383/206 |
| 4,650,079 | A | * | 3/1987 | Tani | 383/206 |
| 4,679,693 | A | * | 7/1987 | Forman | 383/203 |
| 4,709,399 | A | * | 11/1987 | Sanders | 383/66 |
| 4,786,190 | A | * | 11/1988 | Van Erden et al. | 383/203 |
| 4,871,265 | A | * | 10/1989 | Peck | 383/89 |
| 5,400,957 | A | | 3/1995 | Stude | |
| D363,018 | S | | 10/1995 | Stokes et al. | |
| 5,466,734 | A | * | 11/1995 | Catena et al. | 524/230 |
| 5,676,466 | A | | 10/1997 | Lindenbeck | |
| 5,738,274 | A | | 4/1998 | Stude | |
| 5,743,070 | A | | 4/1998 | Lerner et al. | |
| 5,855,435 | A | * | 1/1999 | Chiesa | 383/204 |
| 5,897,210 | A | * | 4/1999 | Giblin et al. | 383/98 |
| 5,908,243 | A | * | 6/1999 | Hanning | 383/5 |
| 6,032,854 | A | | 3/2000 | Greer et al. | |
| 6,070,792 | A | | 6/2000 | Foushee | |
| 6,691,913 | B1 | | 2/2004 | Rodriguez | |
| 6,929,400 | B2 | * | 8/2005 | Razeti et al. | 383/66 |
| 7,033,077 | B2 | * | 4/2006 | Taylor | 383/62 |
| 7,654,064 | B2 | | 2/2010 | Riccardi et al. | |
| 7,726,550 | B2 | | 6/2010 | Wilen | |
| 7,780,069 | B2 | | 8/2010 | Wilen | |
| 8,069,635 | B2 | | 12/2011 | Riccardi et al. | |
| 8,607,980 | B2 | * | 12/2013 | Aldridge et al. | 206/460 |
| 2001/0032872 | A1 | | 10/2001 | Guest | |
| 2002/0030093 | A1 | | 3/2002 | Kim | |
| 2005/0036716 | A1 | | 2/2005 | Geyer | |
| 2008/0041928 | A1 | | 2/2008 | DeLaVergne | |
| 2008/0152264 | A1 | * | 6/2008 | Pokusa et al. | 383/5 |
| 2008/0223007 | A1 | * | 9/2008 | Friebe et al. | 53/545 |

FOREIGN PATENT DOCUMENTS

| | | |
|---|---|---|
| JP | 2010-168054 | 8/2010 |
| WO | 91/04199 | 4/1991 |
| WO | 93/19991 | 10/1993 |

* cited by examiner

RECLOSABLE BAG AND METHODS OF FORMING AND USING SAME

CROSS REFERENCE TO RELATED APPLICATIONS

This application claims priority to and any other benefit of U.S. Provisional Patent Application Ser. No. 61/646,947, filed May 15, 2012, and entitled "RESEALABLE BAG," and U.S. Provisional Patent Application Ser. No. 61/677,685, filed Jul. 31, 2012, and entitled "RECLOSABLE BAG AND METHODS OF FORMING AND USING SAME," the entire disclosures of which are incorporated by reference herein.

TECHNICAL FIELD

The present disclosure relates generally to packaging and in particular to a reclosable bag and methods for forming a reclosable bag and reclosing a product in a reclosable bag.

BACKGROUND

Many consumers prefer to purchase products online or by telephone and have the products shipped to them. Some products, including but not limited to, clothing and other goods, are frequently shipped to a consumer in a sealed bag. The sealed bag may be a one-time use bag, which the consumer will tear open to gain access to the product and then dispose of the torn bag. Alternatively, the sealed bag may be configured as a multi-use bag that permits the consumer to access the product and then, if the consumer is dissatisfied with the product, the consumer may place the product back into the bag, reseal the bag, and return the product to the seller by mail or courier service.

Current multi-use bags generally have an opening for loading and retrieving a product and a lip or tab to close the opening. The lip or tab generally includes two spaced apart lines of adhesive that are covered by a separate release strip. A pair of lines of perforations are provided through the lip or tab between the lines of adhesive. The pair of lines of perforations define an opening strip.

In use, a product may be loaded into the opening of the bag and one release strip may be removed to expose a line of adhesive. Next, the lip or tab is folded over the opening and pressed against the bag to adhere the lip or tab to the bag and thereby close the opening. When the bag containing the product is received, the consumer may open the bag and retrieve the product by pulling on the opening strip to break the lines of perforation. After inspecting the product the consumer may decide that they want to return the product to the seller. If the consumer wants to return the product to the seller, the consumer may insert the product into the bag through the opening. Next, the consumer may remove the remaining release strip to expose the remaining line of adhesive. The consumer may then fold a portion of the lip or tab over the opening and press the lip or tab against the bag to adhere the lip or tab to the bag and thereby cover the opening. The consumer may then return the package to the seller by mail or courier service.

SUMMARY

The present application discloses a reclosable bag and methods for forming a reclosable bag and reclosing a product in a reclosable bag. In an exemplary embodiment, the reclosable bag includes a first ply joined to a second ply to define a main bag portion having a compartment including a first side, a second side, a third side that extends between the first side and the second side, and a product receiving opening that is configured to be hermetically sealed. A reclosing flap is connected to or on the main bag portion, and is spaced apart from the product receiving opening. A reclosing material and a release material are applied to the bag. For example, the reclosing material can be applied to the reclosing flap and/or another portion of the bag, such as the main bag portion, and the release material can be applied to the reclosing flap and/or another portion of the bag, such as the main bag portion. The reclosing flap is configured to move between a passive position, where the reclosing material is releasably adhered to the release material, and an active position, where the reclosing material is adhered to a portion of the bag, such as the main bag portion or the reclosing flap.

In one exemplary embodiment, the reclosable bag also includes a bag opening zone formed in or on the main bag portion proximate the reclosing flap. The bag opening zone can take a wide variety of different forms. The bag opening zone may be defined by one or more lines or areas of weakness, an indicia that indicates where the bag should be cut to open the bag, an adhesive, an openable connection, etc. The bag opening zone is configured to create a product retrieval opening to permit retrieval of a product from the compartment. The product retrieval opening is configured to allow the product to be returned to the compartment through the product retrieval opening. When the product is returned to the compartment, the reclosing flap is moved from the passive position to the active position such that the reclosing material adheres to a portion of the bag and the product retrieval opening is covered to reclose the compartment.

DETAILED DESCRIPTION

The present application relates to a reclosable bag 10 and methods for forming a reclosable bag 10 and reclosing a product 50 in a reclosable bag 10. The reclosable bag 10 is particularly useful as a shipping package for a product 50 that is shipped to a consumer. In addition, the reclosable bag 10 functions as a "multi-use" bag in that the consumer may use the reclosable bag 10 as a return shipping package to return an unwanted or defective product 50 to the seller.

Figure 1A:
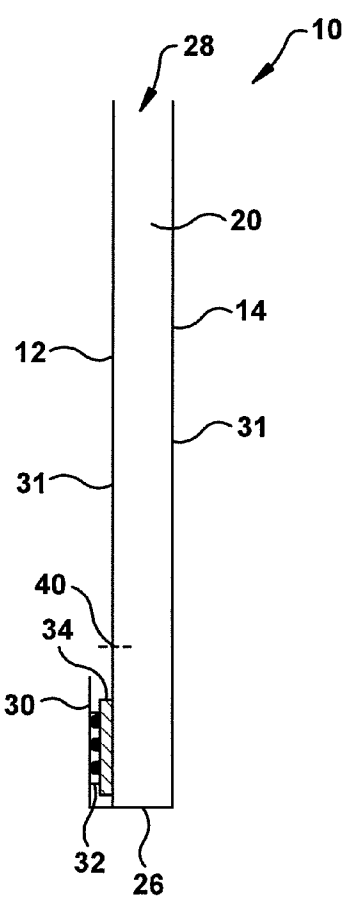
FIG. 1A is a view of the reclosable bag taken along lines 1A-1A in FIG. 1.
Figure 1:
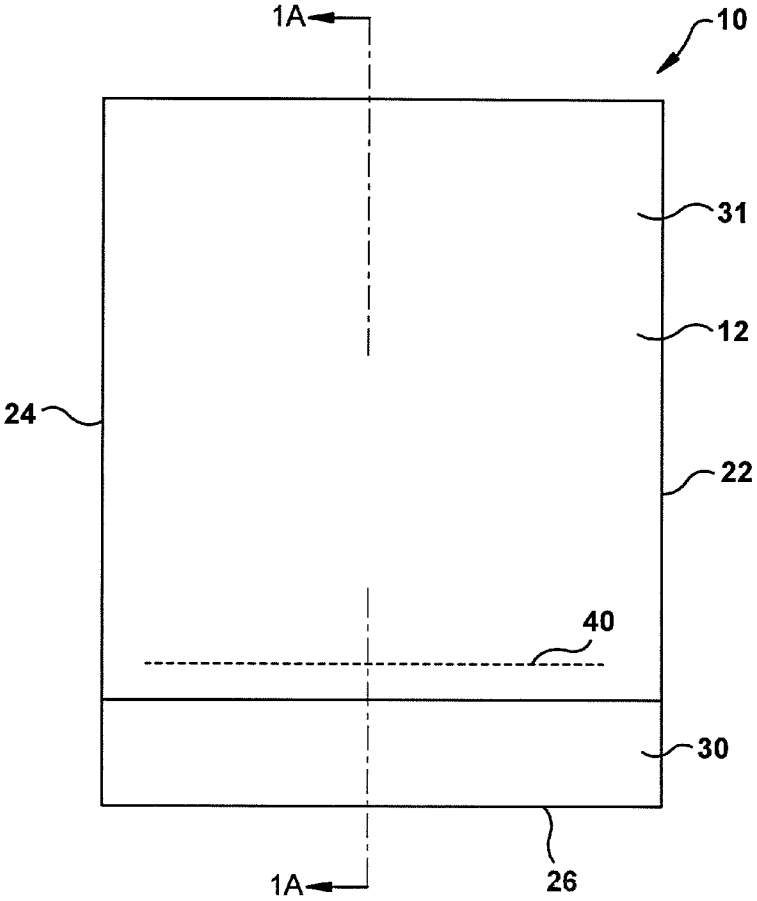
FIG. 1 is a schematic illustration of an exemplary reclosable bag.

Referring to FIGS. 1 and 1A, an exemplary embodiment of a reclosable bag 10 includes a first ply 12 and a second ply 14. The first and second plies 12, 14 may be two separate plies, or a single ply that is folded. As seen in the example, the first ply 12 is joined to the second ply 14 to define a main bag portion 31 having a compartment 20 including a first side 22, a second side 24, a third side 26 that extends between the first side 22 and the second side 24, and a product receiving opening 28 that is configured to be hermetically sealed. In certain embodiments, the first ply 12 may be hermetically joined to the second ply 14 by various techniques including, but not limited to, heat sealing, ultrasonic welding, gluing, etc. Although FIGS. 1 and 1A illustrate the main bag portion 31 as having a single compartment 20, the main bag portion 31 may have any number of compartments.

The first ply 12 and the second ply 14 may be formed of any suitable material. Examples of suitable materials include, but are not limited to, plastic materials, polyethylene, cellophane, vinyl films, pliofilms, cellulose acetate film, polystyrene, polypropylene, and virtually any type of heat sealable or ultrasonic weldable material.

Figure 6A:
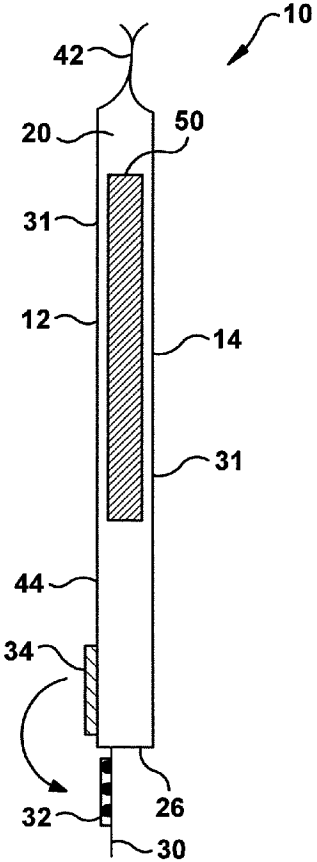
FIG. 6A is a view of the reclosable bag showing the reclosing flap being moved from a passive position to expose the reclosing material taken along lines 6A-6A in FIG. 6.

With continued reference to FIGS. 1 and 1A, the reclosable bag 10 also includes a reclosing flap 30. In certain embodiments, the reclosing flap 30 may be connected to one or more of the first ply 12 and the second ply 14. For example, the reclosing flap 30 may be a separate piece of material that is connected to the first ply 12 or the second ply 14, or both the first ply 12 and the second ply 14, such as the third side 26 of the compartment 20. In other embodiments, the reclosing flap 30 may be integral with the first ply 12 or the second ply 14. For instance, the first ply 12 may be formed with a longer dimension (e.g., length or width) than the second ply 14 such that when the first ply 12 and the second ply 14 are joined, the longer dimension of the first ply 12 may form the reclosing flap 30. In certain other embodiments, the reclosing flap 30 is connected to or on the main bag portion 31 and is spaced apart from the product receiving opening 28. As seen in FIG. 1A, the reclosing flap 30 is spaced apart from the product receiving opening 28, and the reclosing flap 30 extends from the third side 26 (also seen well in FIG. 6A).

The reclosable bag 10 includes a reclosing material 32. The reclosing material 32 may be applied to the bag 10 in a variety of different ways. For example, the reclosing material 32 may be applied to a portion of the reclosing flap 30 and/or to the main bag portion 31. In the embodiments illustrated by FIGS. 1 and 1A and FIGS. 11 and 11A, the reclosing material 32 is applied to a surface of the reclosing flap 30. The reclosing material 32 may take a wide variety of different forms. For example, the reclosing material 32 may be an adhesive. In certain embodiments, the reclosing material 32 is a pressure sensitive adhesive. For instance, the reclosing material 32 may be a pressure sensitive adhesive selected from the group consisting of an acrylic based adhesive, a methacrylate based adhesive, a polyurethane based adhesive, a rubber based adhesive, a styrene copolymer based adhesive, a silicone based adhesive, and combinations thereof. However, those with skill in the art will appreciate that various types of adhesives may be utilized so long as the reclosing material 32 permits the reclosing flap 30 to adhere to an outer surface of a portion of the bag 10, such as one of the first ply 12 or the second ply 14.

The reclosable bag 10 includes a release material 34. The release material 34 may be applied to the bag 10 in a variety of different ways. For example, the release material may be applied to the main bag portion 31 and/or the reclosing flap 30. The release material 34 may be printed, laminated, sprayed, or otherwise deposited and/or adhered to the main bag portion 31 and/or the reclosing flap 30. In the embodiment illustrated by FIGS. 1 and 1A, the release material 34 is applied to a surface of the main bag portion 31. In the embodiment illustrated by FIGS. 11 and 11A, the release material 34 is applied to a surface of the reclosing flap 30. The release material 34 may take a variety of different forms. In certain embodiments, the release material 34 may be a chemical release material selected from the group consisting of polyacrylates, carbamates, polyolefins, fluorocarbons, chromium stearate complexes, silicones, and combinations thereof. As will be discussed in more detail below, the reclosing flap 30 is configured to move between a passive position where the reclosing material 32 is releasably adhered to the release material 34, and an active position where the reclosing material 32 is adhered to a portion of the bag 10 to reclose the bag 10. For example, the reclosing material 32 may adhere to the main bag portion 31 and/or the reclosing material 32 may adhere to the reclosing flap 30. In the example illustrated by FIG. 7A, the reclosing material 32 is adhered to the main bag portion 31 at the outer surface of the first ply 12. In certain embodiments, the selection of the reclosing material 32 and the release material 34 is such that the adhesion between the reclosing material 32 and the release material 34 is strong enough to prevent unintentional separation during transit. For example, when the reclosing material 32 and the release material 34 are in releasable adhesive communication, the adhesion may be characterized as having a peel strength of 1 N/cm to 5 N/cm to separate the reclosing material 32 from the release material 34.

Referring now to FIG. 1, the reclosable bag 10 further includes a bag opening zone 40 formed in or on the main bag portion 31 proximate the reclosing flap 30. The bag opening zone 40 can take a wide variety of different forms. For example, the bag opening zone 40 may be defined by one or more lines or areas of weakness, an indicia that indicates where the bag 10 should be cut to open the bag 10, an adhesive, an openable connection, etc. Any arrangement that secures the product 50 in the bag 10 during transit, but allows the consumer to easily open the bag 10 can be employed. A line or area of weakness may be a line or lines of perforations through a portion of the main bag portion 31, a score line or lines that weaken a portion of the main bag portion 31 along a line or area, or other processing known in the art that weakens a portion of the main bag portion 31 to allow the bag 10 to be opened.

Figure 2A:
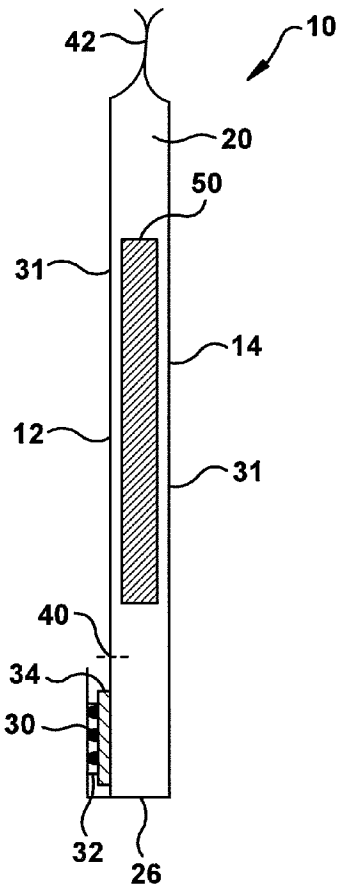
FIG. 2A is a view of the reclosable bag containing a product taken along lines 2A-2A in FIG. 2.
Figure 2:
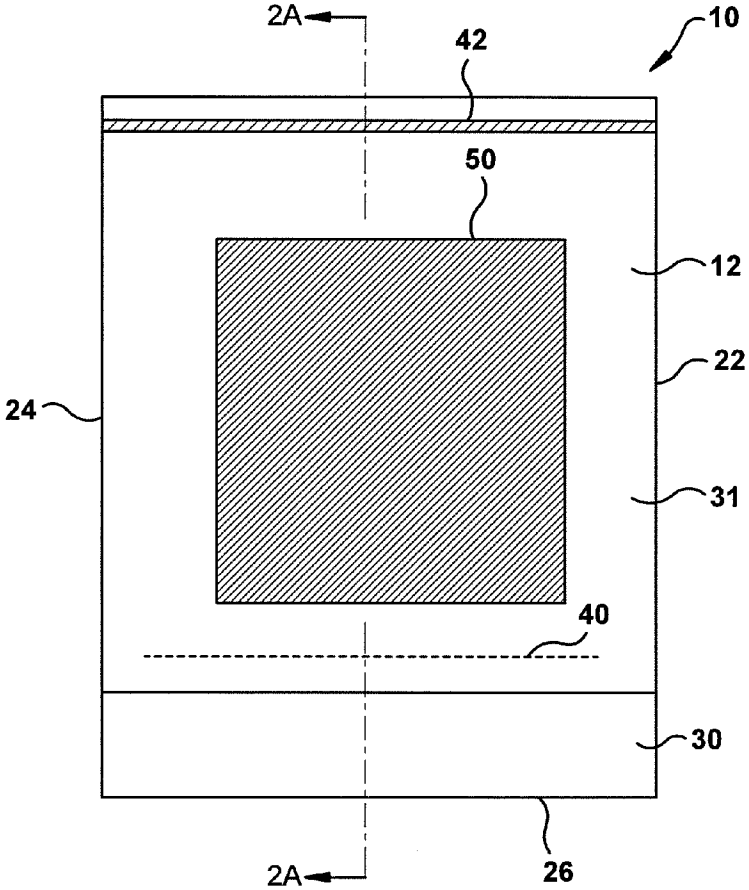
FIG. 2 is a schematic illustration of an exemplary reclosable bag containing a product.

Referring now to FIGS. 2 and 2A, an exemplary reclosable bag 10 containing a product 50 is illustrated. The product 50 is loaded into the compartment 20 through the product receiving opening 28, seen in FIG. 1A, and then the product receiving opening 28 is sealed, as shown by seal 42, to retain the product 50. In the example, the seal 42 extends from the first side 22 to the second side 24 to seal the compartment 20. In another embodiment, the seal 42 may not extend all the way from the first side 22 to the second side 24 or may be intermittent to allow communication between the compartment 20 and external air or the compartment 20 and another optional compartment of the reclosable bag 10. In certain embodiments, the seal 42 may be formed by various techniques including, but not limited to, heat sealing, ultrasonic welding, gluing, etc. Virtually any type of product 50 may be loaded into the reclosable bag 10 for delivery to a consumer. Examples of packaging machines that may be used to form the seal 42 are disclosed by U.S. Pat. Nos. 7,654,064; 8,069,635; and 5,743,070, as is described in more detail below. U.S.

Pat. Nos. 7,654,064; 8,069,635; and 5,743,070 are incorporated herein by reference in their entirety.

Figure 3A:
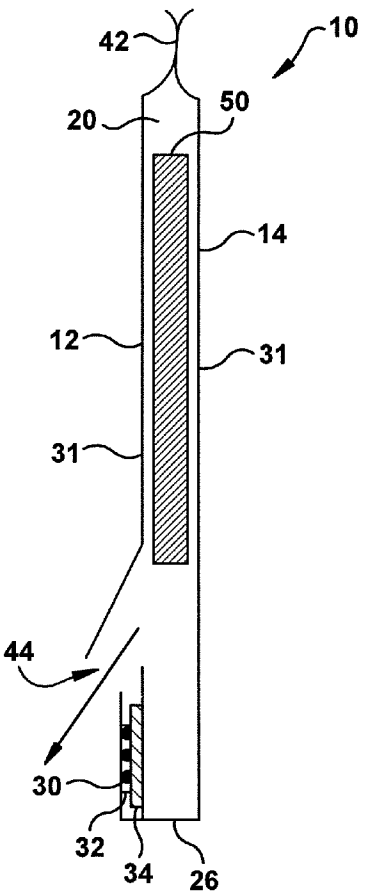
FIG. 3A is a view of the reclosable bag showing a product retrieval opening taken along lines 3A-3A in FIG. 3.
Figure 3:
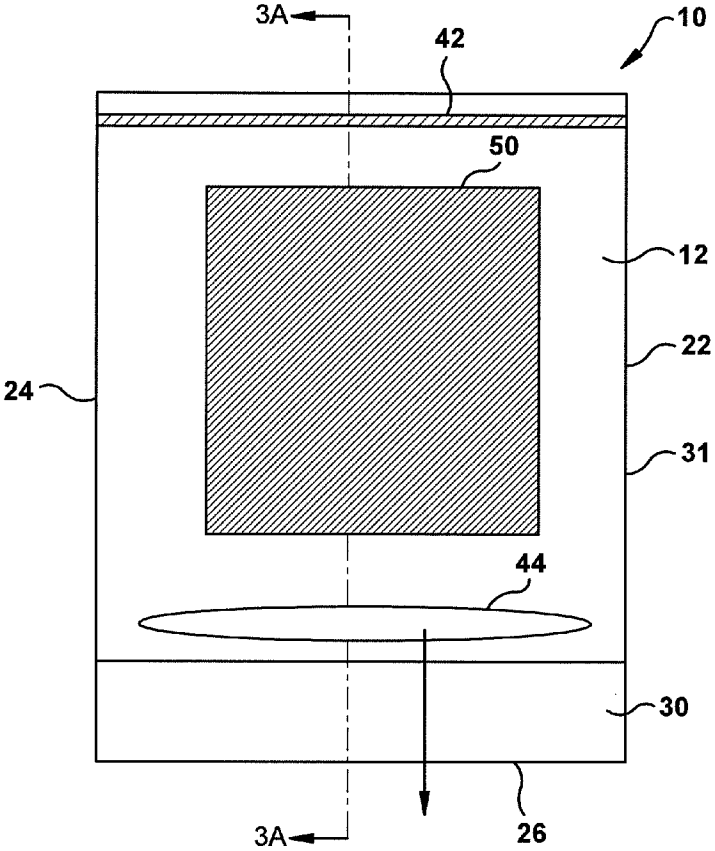
FIG. 3 is a schematic illustration of an exemplary reclosable bag showing a product retrieval opening for retrieving the product.

When the reclosable bag 10 containing a product 50 is received, the consumer may open the reclosable bag 10 to retrieve the product 50. As seen in FIGS. 3 and 3A, access to the product 50 is provided by the bag opening zone 40, which is configured to be broken or otherwise opened to create a product retrieval opening 44 to permit retrieval of the product 50 from the compartment 20, as indicated by the directional arrow. In certain embodiments, the bag opening zone 40 may extend from the first side 22 to the second side 24 to provide a larger opening, while in other embodiments the bag opening zone 40 may be intermittent to provide a plurality of openings that provide access to a plurality of compartments.

Figure 4:
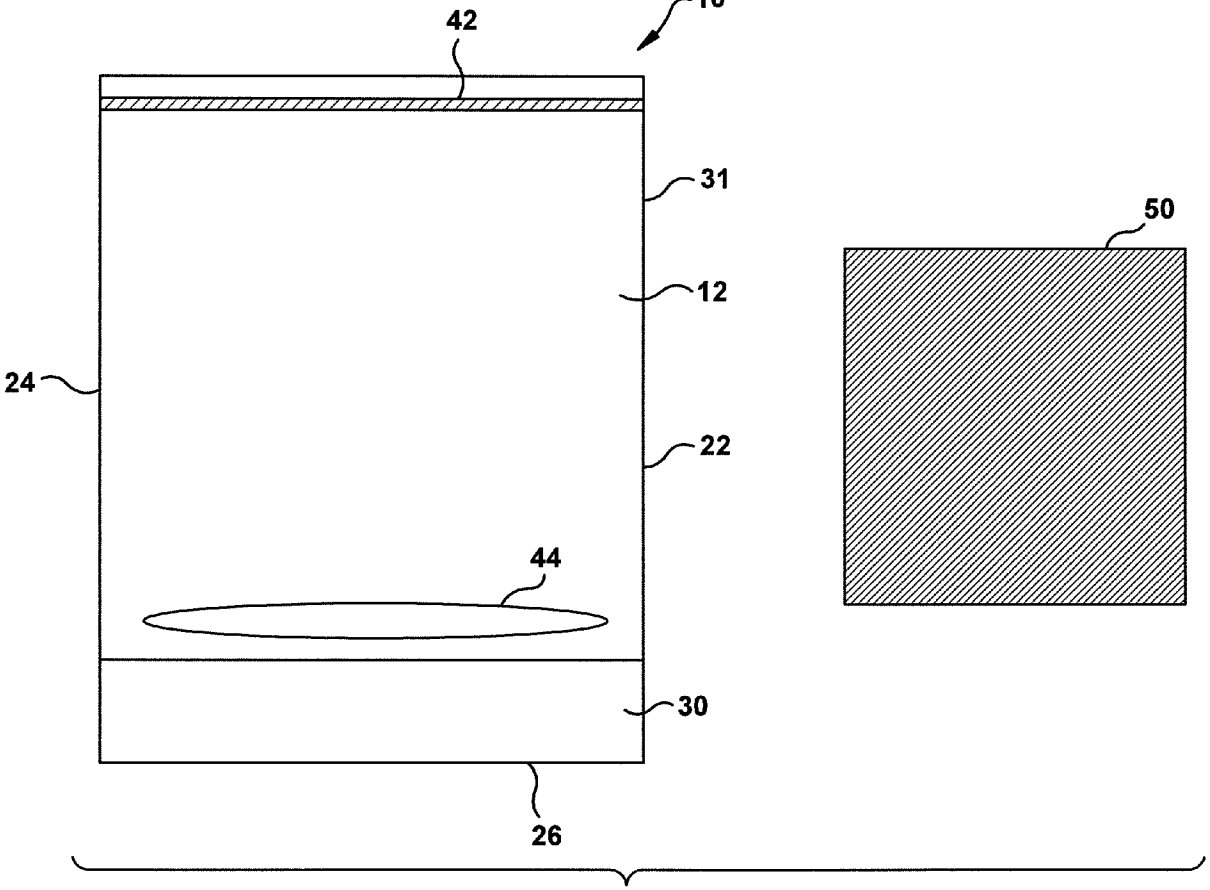
FIG. 4 is a schematic illustration of an exemplary reclosable bag showing the product removed from the bag.
Figure 5A:
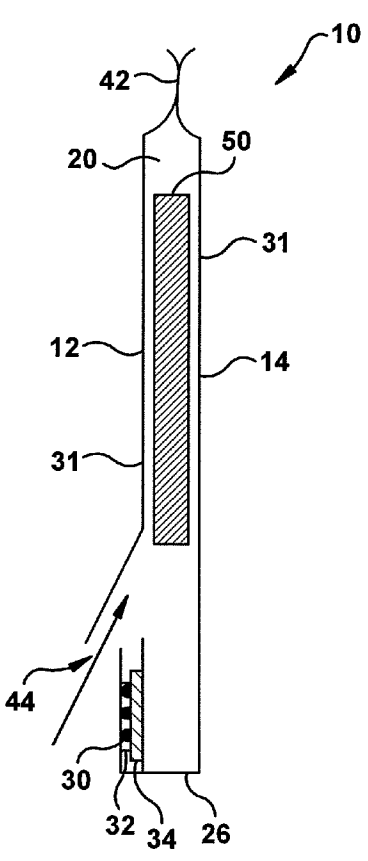
FIG. 5A is a view of the reclosable bag showing the product being returned to the bag taken along lines 5A-5A in FIG. 5.
Figure 5:
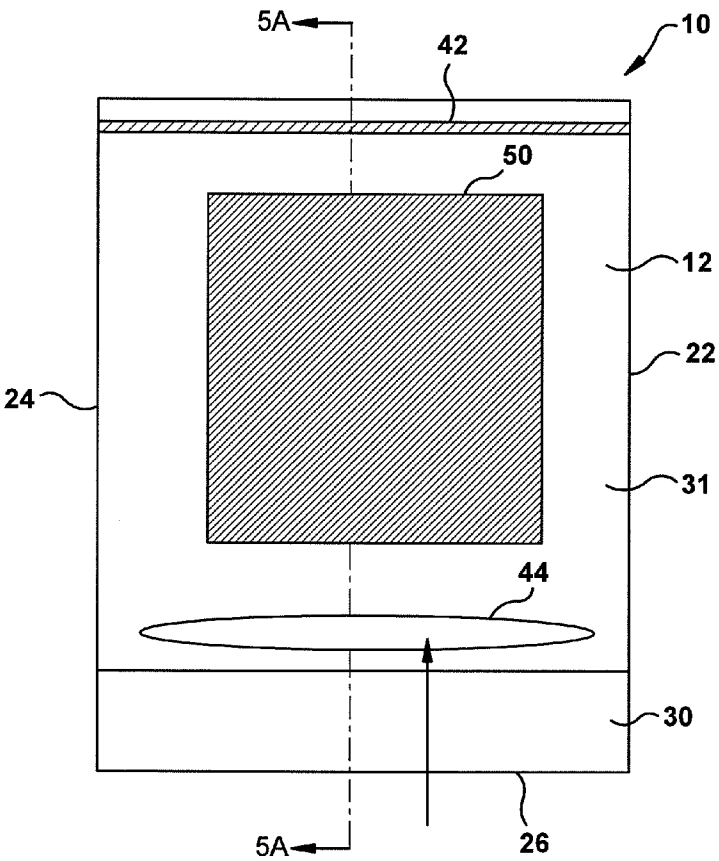
FIG. 5 is a schematic illustration of an exemplary reclosable bag showing the product being returned to the bag.

Referring now to FIG. 4, after the consumer retrieves the product 50 from the compartment 20, the consumer may inspect the product 50. Upon inspection, the consumer may determine that the product 50 is defective, or the consumer may decide that they do not want or do not need the product 50. The reclosable bag 10 allows the consumer to return the product 50 to the seller without having to utilize any additional packaging materials (e.g., packaging tape) and without generating any waste. As seen in FIGS. 5 and 5A, the product retrieval opening 44 is configured to allow the product 50 to be returned to the compartment 20 through the product retrieval opening 44, as indicated by the directional arrow. In the illustrated embodiment, the product 50 is returned to the compartment 20 at an opening (i.e., the product retrieval opening 44) that is different from the opening (i.e., the product receiving opening 28) through which the product 50 was originally loaded into the compartment 20.

Figure 6:
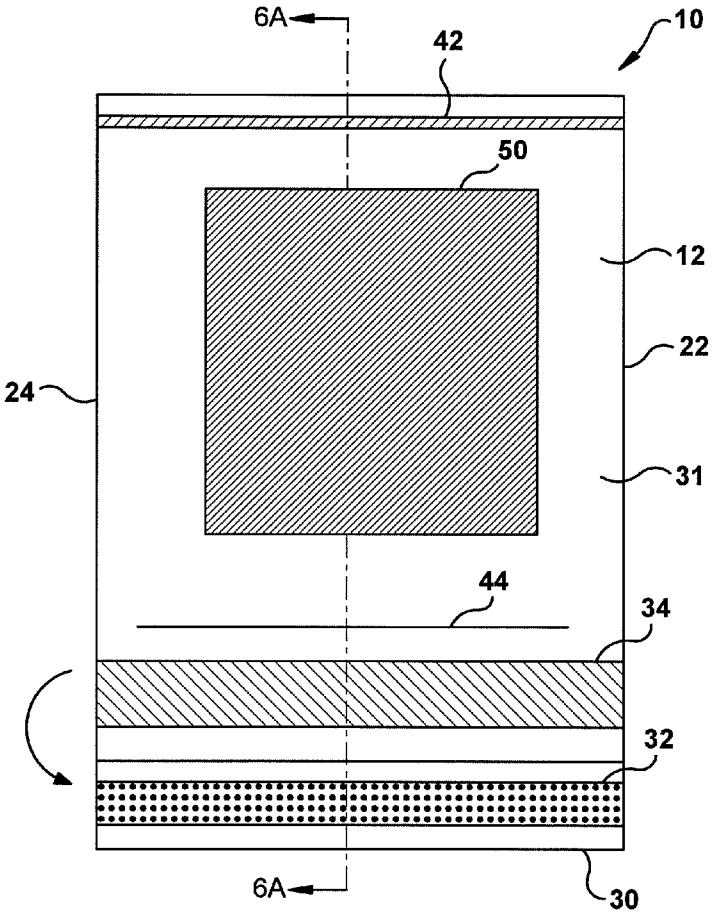
FIG. 6 is a schematic illustration of an exemplary reclosable bag showing a reclosing flap being moved from a passive position to expose a reclosing material.
Figure 7A:
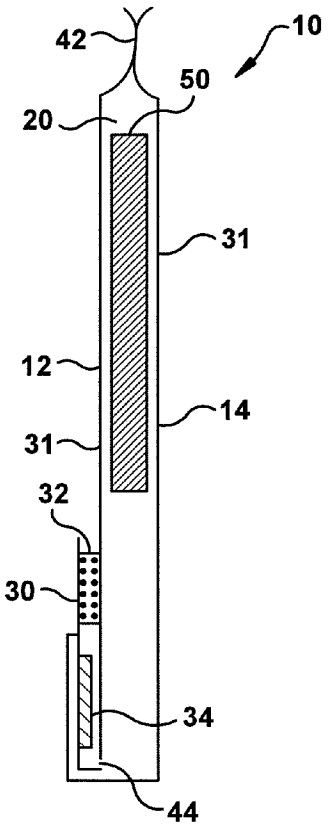
FIG. 7A is a view of the reclosable bag showing the reclosing flap in the active position and the product retrieval opening being covered taken along lines 7A-7A in FIG. 7.
Figure 7:
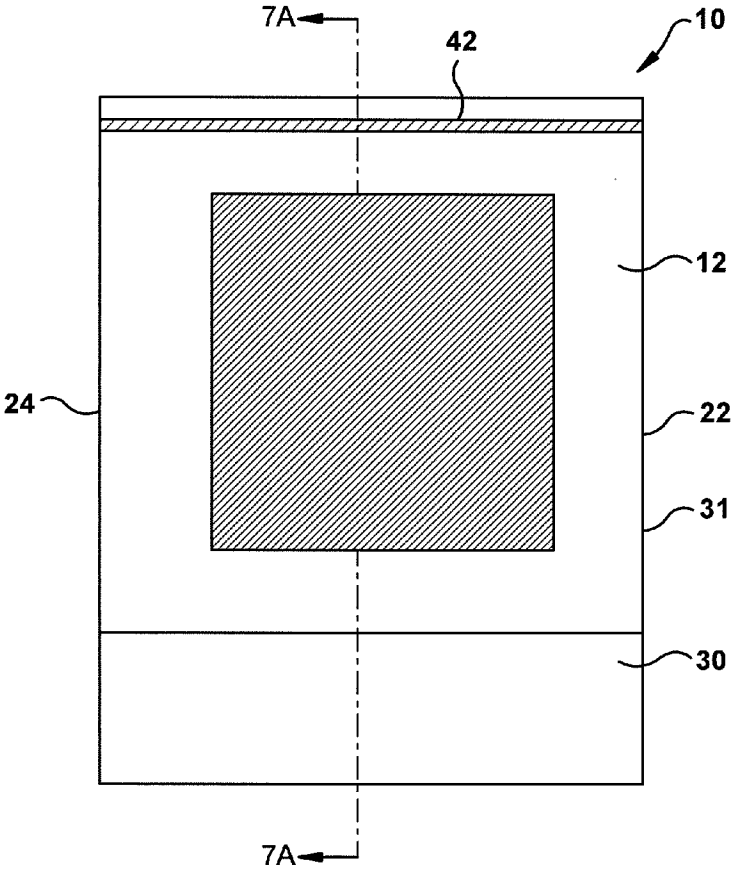
FIG. 7 is a schematic illustration of an exemplary reclosable bag showing a reclosing flap in an active position and a product retrieval opening being covered.

When the product 50 has been returned to the compartment 20, the reclosable bag 10 may be reclosed to return the product 50 to the seller. As shown in FIG. 5A, the reclosing flap 30 is in the passive position where the reclosing material 32 is releasably adhered to the release material 34. As indicated by the directional arrow in FIGS. 6 and 6A, the reclosing flap 30 is movable from the passive position by pulling on the reclosing flap 30 to separate the reclosing material 32 from the release material 34. When the reclosing flap 30 is moved from the passive position, the reclosing material 32 is exposed. Then the reclosing flap 30 may be moved to the active position such that the reclosing material 32 is brought into contact with and adheres to a portion of the bag 10, such as an outer surface of the main bag portion 31, as illustrated in FIG. 7A. After the reclosing flap 30 is moved to the active position, the product retrieval opening 44 is covered to reclose the compartment 20 with the product 50 retained therein, as seen in FIGS. 7 and 7A. Now that the product 50 is within the compartment 20 and the compartment 20 has been reclosed, the consumer may return the product 50 to the seller by mail or courier service.

Figure 8B:
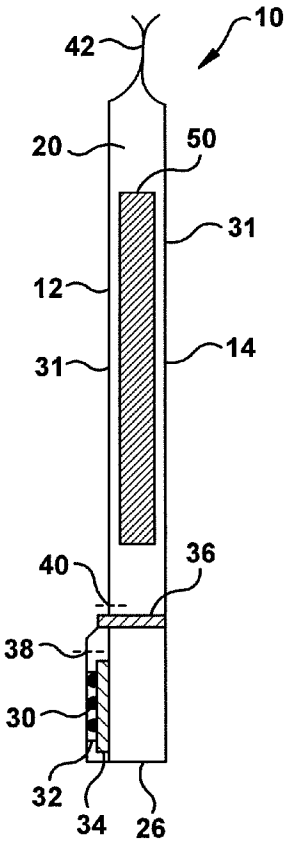
FIG. 8B is a side cross-sectional view of an exemplary reclosable bag containing a product showing a reclosing flap sealed to a first ply and a second ply of the bag.
Figure 8A:
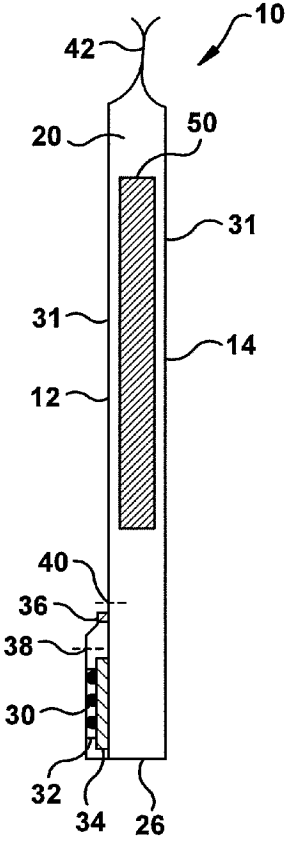
FIG. 8A is a view of the reclosable bag containing a product showing a reclosing flap sealed to a first ply of the bag taken along line 8A-8A in FIG. 8.
Figure 8:
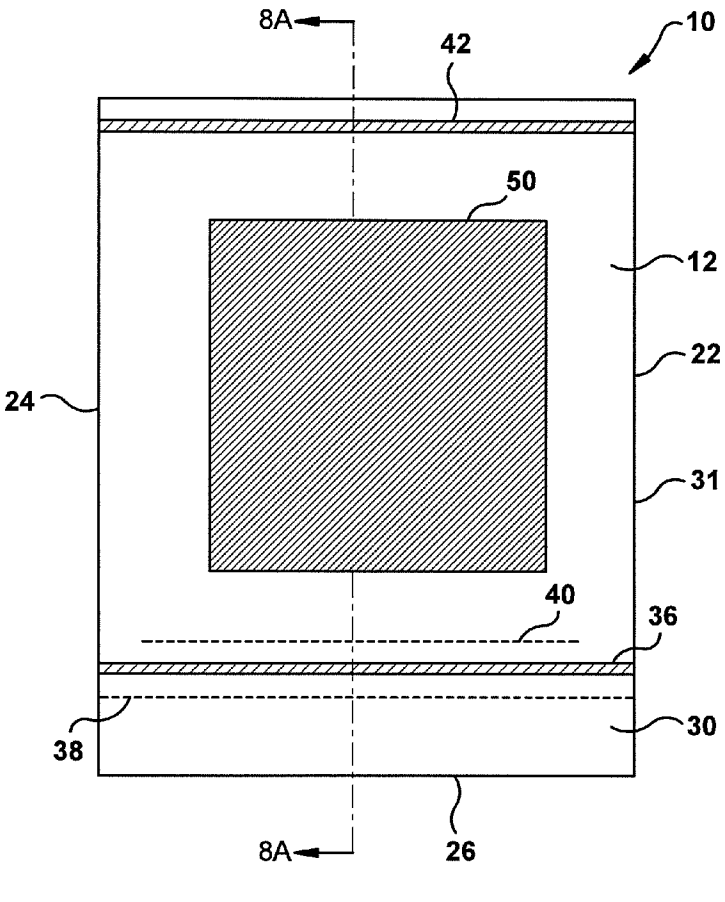
FIG. 8 is a schematic illustration of an exemplary reclosable bag containing a product.

Referring now to FIGS. 8, 8A, and 8B, an additional exemplary reclosable bag 10 is shown. In this example, the reclosable bag 10 includes a reclosing flap 30 that is connected to the first ply 12 and/or the second ply 14. For example, the reclosing flap 30 can be connected to the first ply 12 and/or the second ply 14 by a reclosing flap seal 36. In certain other embodiments, a portion of the reclosing flap 30 may be sealed to another portion of the reclosing flap 30. The reclosing flap seal 36 prevents the reclosing flap 30 from moving from the passive position during transit so that the reclosing material 32 is not unintentionally exposed. In the example of FIG. 8A, the reclosing flap 30 is sealed to the first ply 12. As seen in the example of FIG. 8B, the reclosing flap 30 is sealed to both the first ply 12 and the second ply 14. Again, various sealing techniques known to those of skill in the art may be utilized to form the reclosing flap seal 36 including, but not limited to, heat sealing, ultrasonic welding, gluing, etc. Although the reclosing flap seal 36 is illustrated as extending from the first side 22 to the second side 24, in another embodiment, the reclosing flap seal 36 may not extend all the way from the first side 22 to the second side 24 or may be intermittent so long as the reclosing flap seal 36 prevents the reclosing flap 30 from moving from the passive position and unintentionally exposing the reclosing material 32.

With continued reference to FIGS. 8, 8A, and 8B, in this example the reclosing flap 30 is formed with a line or area of reduced strength 38 to permit separation of the reclosing flap 30 from the main bag portion 31. The line or area of reduced strength 38 may be a line or lines of perforations, a score line or lines, or other configurations that promote separation that are known to those of skill in the art. As with the previous examples, the product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44.

Figure 8D:
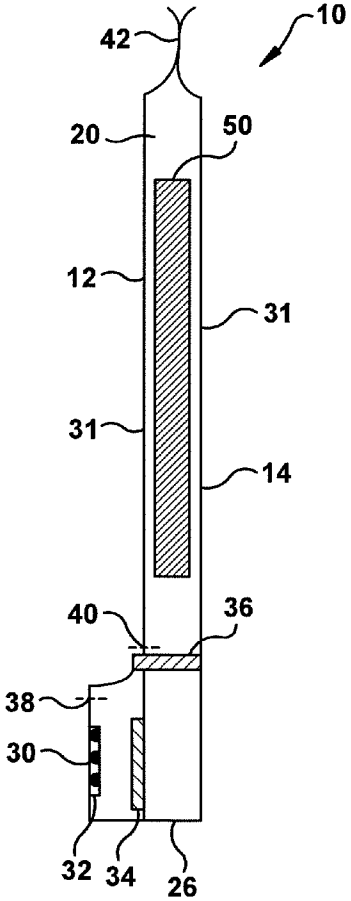
FIG. 8D is a view of an exemplary reclosable bag containing a product showing a reclosing flap spaced apart from a first ply of the bag.
Figure 8C:
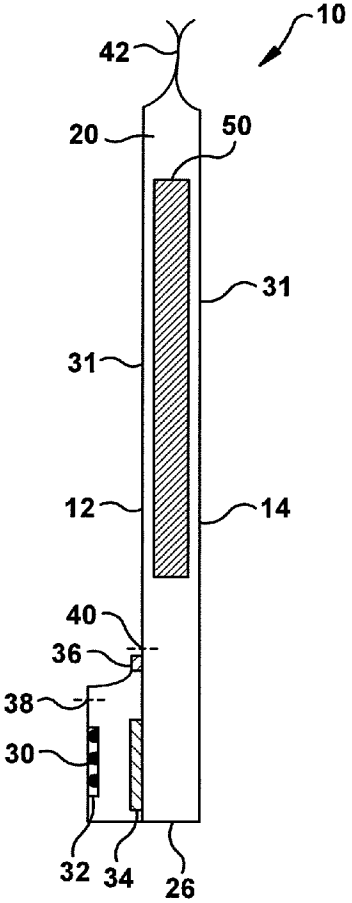
FIG. 8C is a view of an exemplary reclosable bag containing a product showing a reclosing flap spaced apart from a first ply of the bag.

As seen in FIGS. 8A and 8B, the reclosing flap 30 is in the passive position where the reclosing material 32 is releasably adhered to the release material 34. FIGS. 8C and 8D illustrate another exemplary embodiment where the reclosing material 32 is not adhered to the release material 34. In the example illustrated by FIGS. 8C and 8D, the reclosing material 32 is adjacent to, but spaced apart from the release material 34. As such, the release material 34 is configured to prevent the reclosing material 32 from permanently adhering to another portion of the bag 10 when the reclosing flap 30 is in the passive position in the FIGS. 8C and 8D embodiments. The spaced apart configuration of the reclosing material 32 and the release material 34 of FIGS. 8C and 8D can be applied to any of the embodiments where the reclosing flap 30 is connected to another portion of the bag 10 in the passive position (See for example, FIGS. 14A and 21A). In the embodiments illustrated by FIGS. 8C and 8D, the reclosing material 32 may come into contact and releasably adhere to the release material 34 during use or the reclosing material 32 and the release material 34 may be configured such that reclosing material 32 does not adhere to the release material 34 when they come into contact.

Figure 9A:
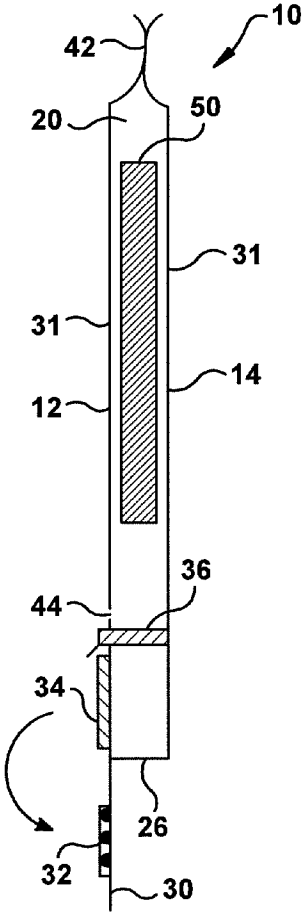
FIG. 9A is a view of the reclosable bag showing the reclosing flap being moved from the passive position to expose the reclosing material taken along lines 9A-9A in FIG. 9.
Figure 9:
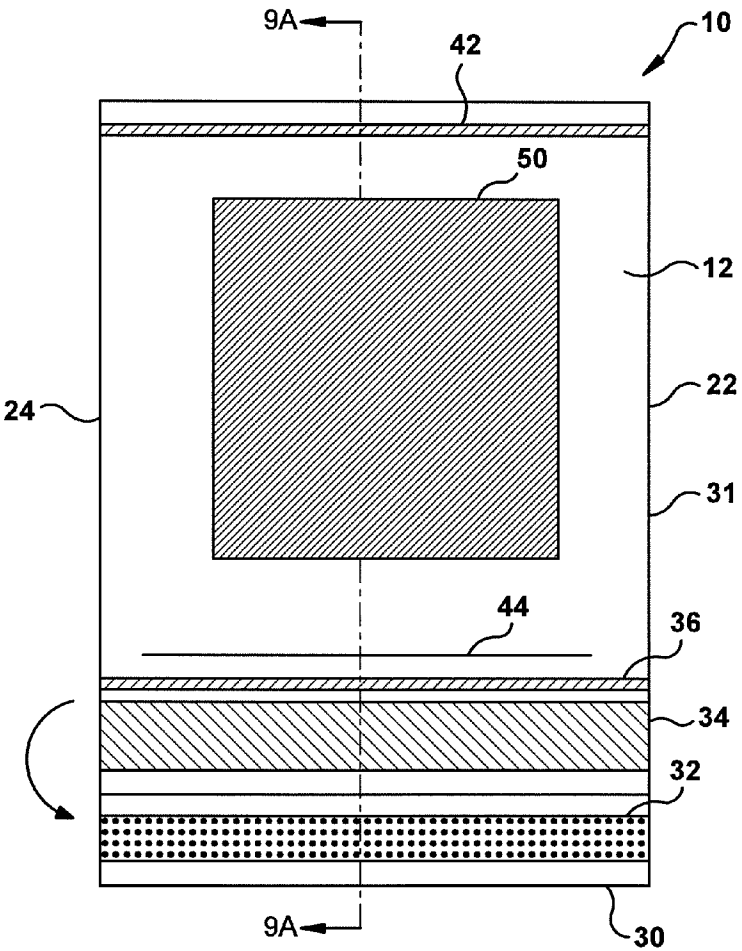
FIG. 9 is a schematic illustration of an exemplary reclosable bag showing a reclosing flap being moved from a passive position to expose a reclosing material.
Figure 10A:
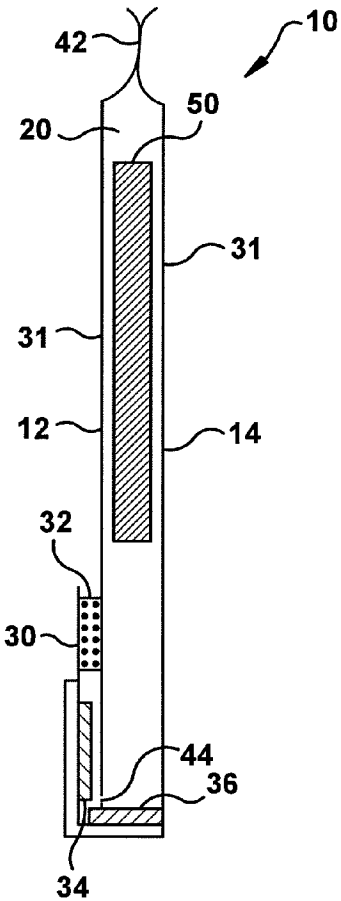
FIG. 10A is a view of the reclosable bag showing the reclosing flap in the active position and the product retrieval opening being covered taken along lines 10A-10A in FIG. 10.
Figure 10:
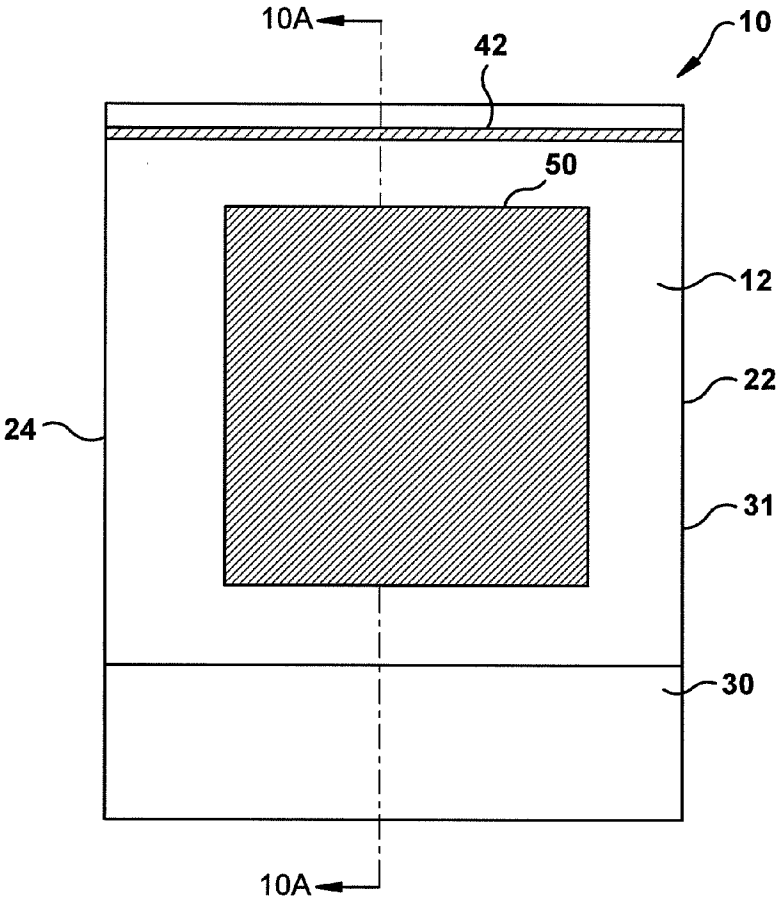
FIG. 10 is a schematic illustration of an exemplary reclosable bag showing a reclosing flap in an active position and a product retrieval opening being covered.

As indicated by the directional arrow in FIGS. 9 and 9A, the reclosing flap 30 is movable from the passive position by: first, breaking the line of reduced strength 38 to separate the reclosing flap 30 from the main bag portion 31; and next, pulling on the reclosing flap 30 to separate the reclosing material 32 from the release material 34. When the reclosing flap 30 is moved from the passive position, the reclosing material 32 is exposed. Then the reclosing flap 30 may be moved to the active position where the reclosing material 32 is brought into contact with and adheres to an outer surface of the main bag portion 31, as illustrated in FIG. 10A. After the reclosing flap 30 is moved to the active position, the product retrieval opening 44 is covered to reclose the compartment 20 with the product 50 retained therein, as seen in FIGS. 10 and 10A. When the product 50 is within the compartment 20 and the compartment 20 has been reclosed, the consumer may return the product to the seller by mail or courier service.

Figure 11A:
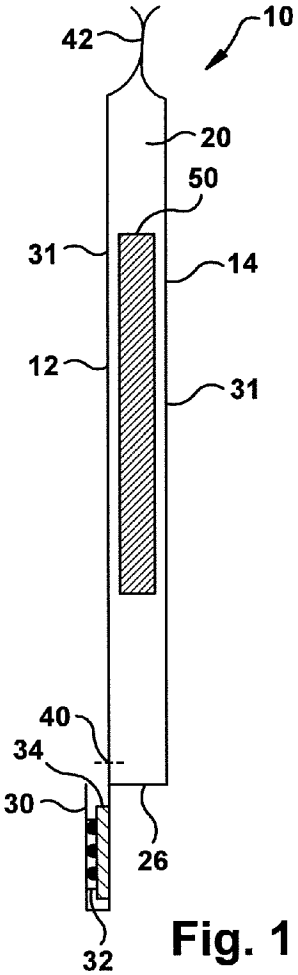
FIG. 11A is a view of the reclosable bag containing a product taken along lines 11A-11A in FIG. 11.
Figure 11:
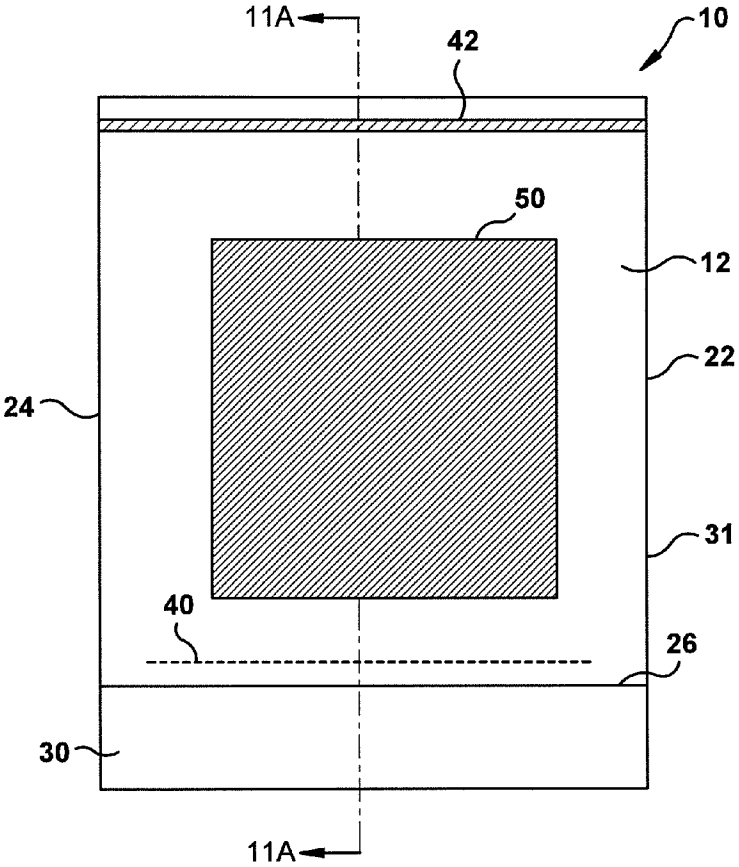
FIG. 11 is a schematic illustration of an exemplary reclosable bag containing a product.

Referring now to FIGS. 11-13A, an additional exemplary reclosable bag 10 is illustrated. In this particular example, the reclosing material 32 and the release material 34 are both applied to a surface of the reclosing flap 30. As seen in FIG. 11A, the reclosing flap 30 is in the passive position with the reclosing material 32 releasably adhered to the release material 34. As with the first example, the product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44.

Figure 12A:
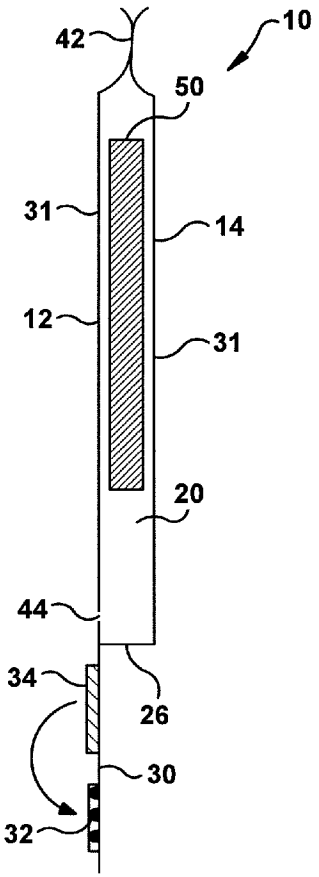
FIG. 12A is a view of the reclosable bag showing the reclosing flap being moved from a passive position to expose the reclosing material taken along lines 12A-12A in FIG. 12.
Figure 12:
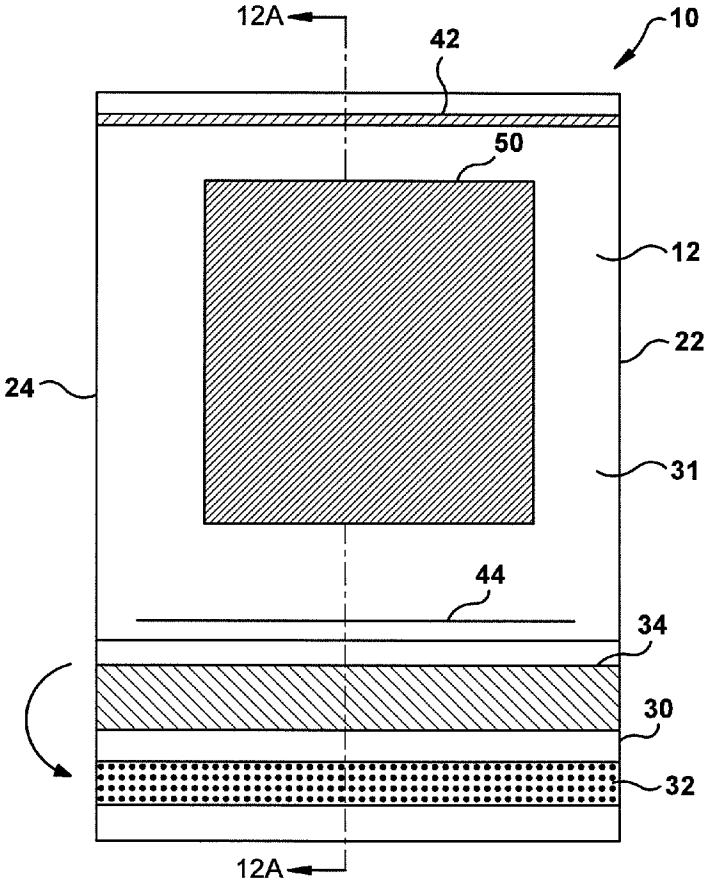
FIG. 12 is a schematic illustration of an exemplary reclosable bag showing a reclosing flap being moved from a passive position to expose a reclosing material.
Figure 13A:
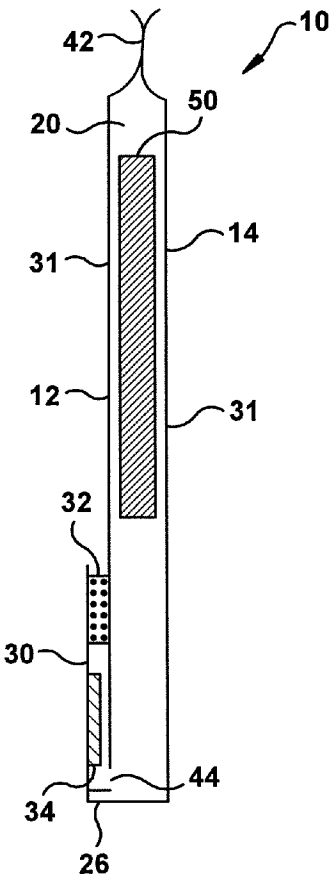
FIG. 13A is a view of the reclosable bag showing the reclosing flap in the active position and the product retrieval opening being covered taken along lines 13A-13A in FIG. 13.
Figure 13:
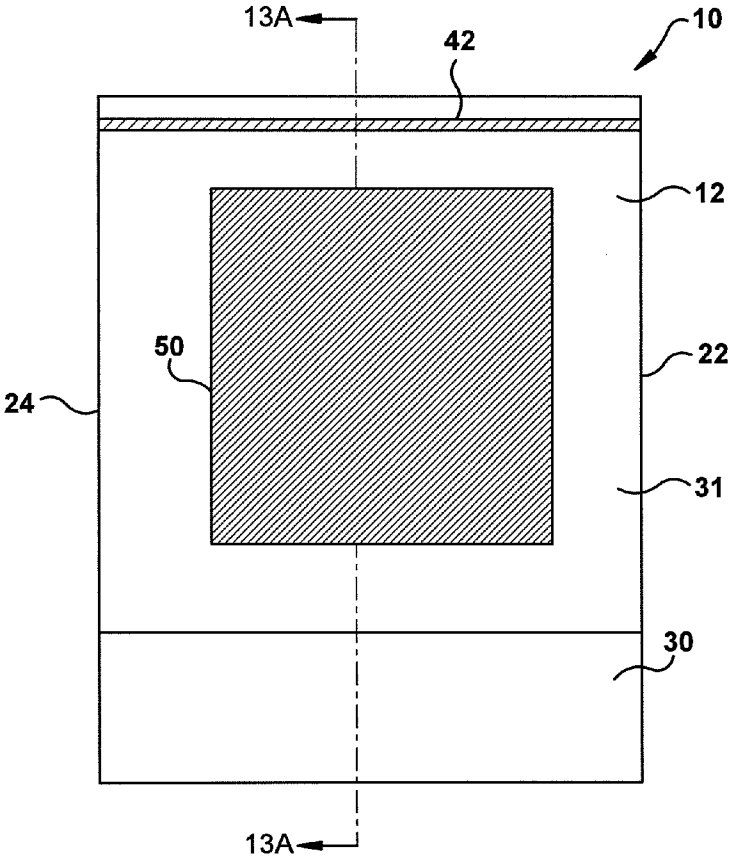
FIG. 13 is a schematic illustration of an exemplary reclosable bag showing a reclosing flap in an active position and a product retrieval opening being covered.

As indicated by the directional arrow in FIGS. 12 and 12A, the reclosing flap 30 is movable from the passive position by pulling on the reclosing flap 30 to separate the reclosing material 32 from the release material 34. When the reclosing flap 30 is moved from the passive position, the reclosing material 32 is exposed. Then the reclosing flap 30 may be moved to the active position where the reclosing material 32 is brought into contact with and adheres to an outer surface of the main bag portion 31, as illustrated in FIG. 13A. After the reclosing flap 30 is moved to the active position, the product retrieval opening 44 is covered to reclose the compartment 20 with the product 50 retained therein, as seen in FIGS. 13 and 13A. When the product 50 is within the compartment 20 and the compartment 20 has been reclosed, the consumer may return the product to the seller by mail or courier service.

An additional exemplary reclosable bag 10 is illustrated in FIGS. 14-16A. In this example, the reclosing material 32 and the release material 34 are both applied to a surface of the reclosing flap 30, and a portion of the reclosing flap 30 is sealed to another portion of the reclosing flap 30, as indicated by reclosing flap seal 36. As discussed above, the reclosing flap seal 36 prevents the reclosing flap 30 from moving from the passive position during transit so that the reclosing material 32 is not unintentionally exposed. The reclosing flap seal 36 may be formed by various techniques known to those skilled in the art including, but not limited to, heat sealing, ultrasonic welding, gluing, etc. Although the reclosing flap seal 36 is illustrated as extending from the first side 22 to the second side 24, in certain other embodiments, the reclosing flap seal 36 may not extend all the way from the first side 22 to the second side 24 or may be intermittent so long as the reclosing flap seal 36 prevents the reclosing flap 30 from moving from the passive position and unintentionally exposing the reclosing material 32.

With continued reference to FIGS. 14-16A, in this example the reclosing flap 30 is formed with a line or area of reduced strength 38 to permit separation of a portion of the reclosing flap 30 from another portion of the reclosing flap 30. The line or area of reduced strength 38 may be a line or lines of perforations, a score line or lines, or other configurations that promote separation that are known to those of skill in the art. As with the previous examples, the product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44.

Figure 14A:
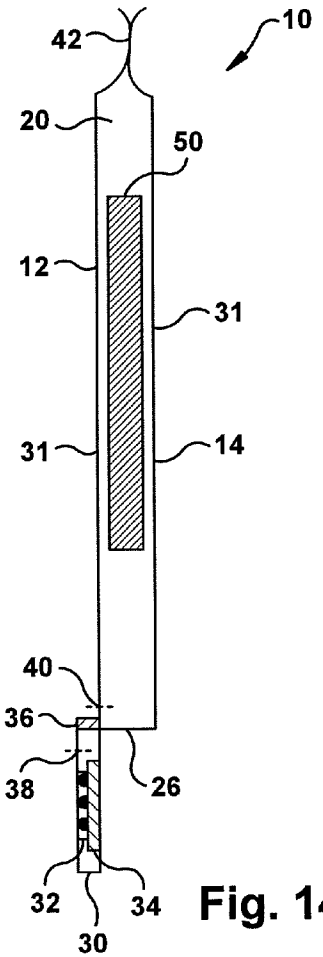
FIG. 14A is a view of the reclosable bag containing a product showing a reclosing flap sealed to a main bag portion of the bag taken along line 14A-14A in FIG. 14.
Figure 14:
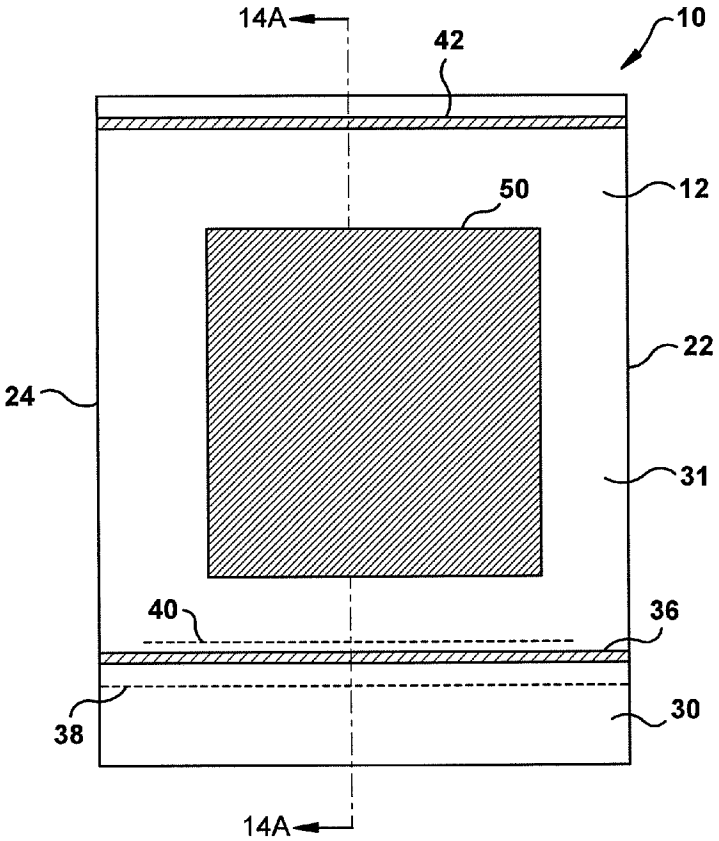
FIG. 14 is a schematic illustration of an exemplary reclosable bag containing a product.
Figure 15A:
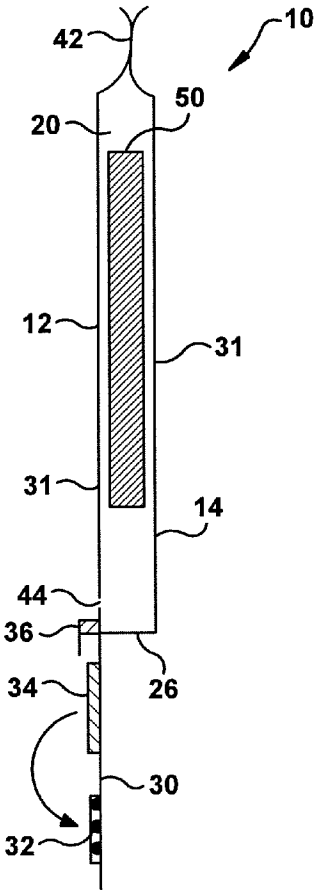
FIG. 15A is a view of the reclosable bag showing the reclosing flap being moved from a passive position to expose the reclosing material taken along lines 15A-15A in FIG. 15.
Figure 15:
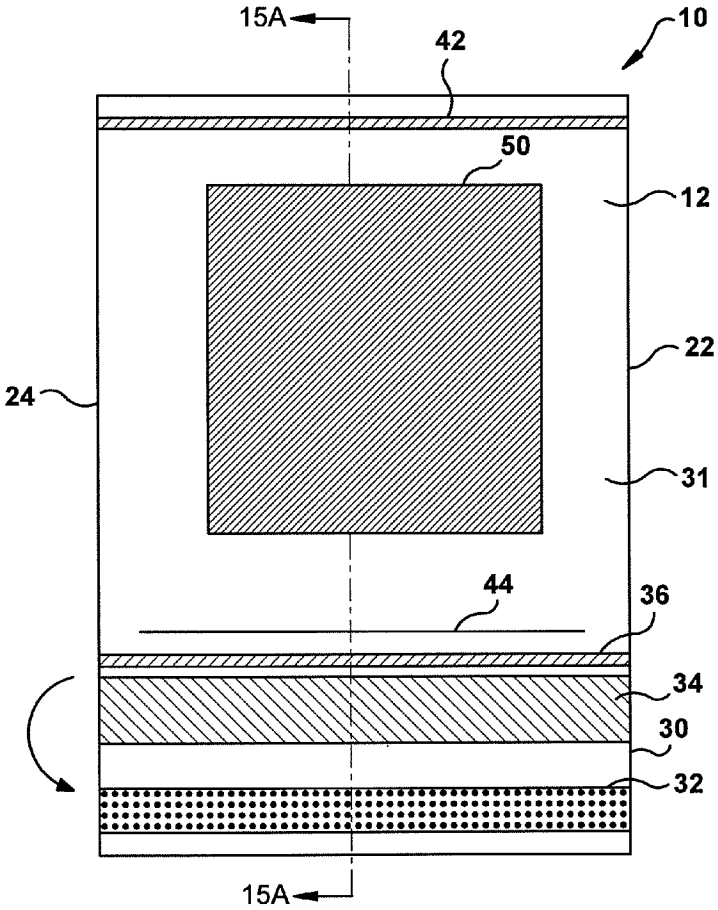
FIG. 15 is a schematic illustration of an exemplary reclosable bag showing a reclosing flap being moved from a passive position to expose a reclosing material.
Figure 16A:
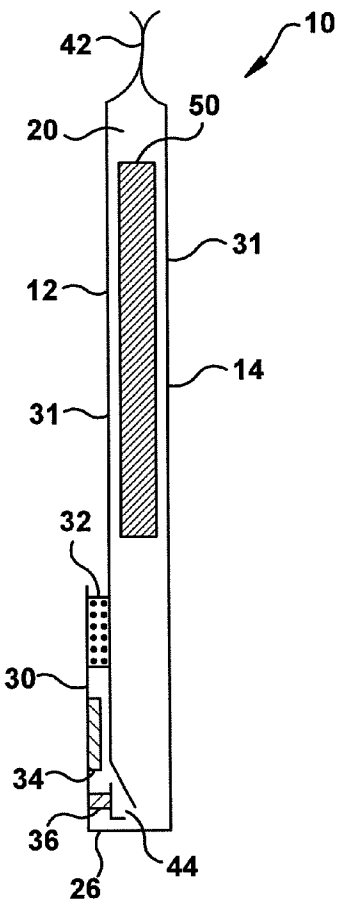
FIG. 16A is a view of the reclosable bag showing the reclosing flap in the active position and the product retrieval opening being covered taken along lines 16A-16A in FIG. 16.
Figure 16:
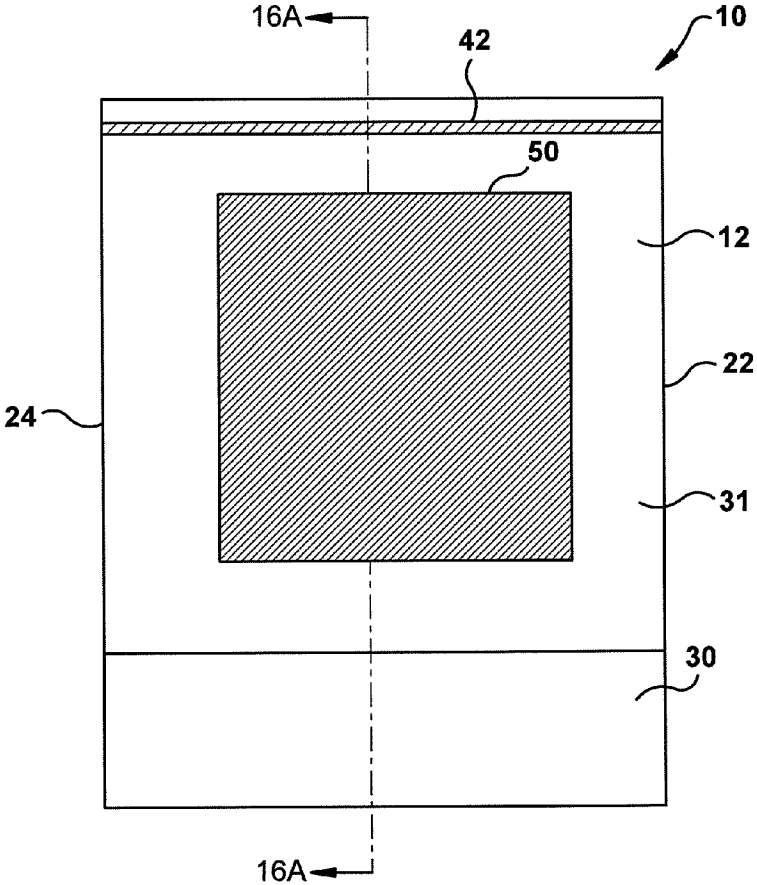
FIG. 16 is a schematic illustration of an exemplary reclosable bag showing a reclosing flap in an active position and a product retrieval opening being covered.

As seen in FIGS. 14 and 14A, the reclosing flap 30 is in the passive position where the reclosing material 32 is releasably adhered to the release material 34. As indicated by the directional arrow in FIGS. 15 and 15A, the reclosing flap 30 is movable from the passive position by: first, breaking the line of reduced strength 38 to separate a portion of the reclosing flap 30 from another portion of the reclosing flap 30; and next, pulling on the reclosing flap 30 to separate the reclosing material 32 from the release material 34. When the reclosing flap 30 is moved from the passive position, the reclosing material 32 is exposed. Then the reclosing flap 30 may be moved to the active position where the reclosing material 32 is brought into contact with and adheres to an outer surface of the main bag portion 31, as illustrated in FIG. 16A. After the reclosing flap 30 is moved to the active position, the product retrieval opening 44 is covered to reclose the compartment 20 with the product 50 retained therein, as seen in FIGS. 16 and 16A. When the product 50 is within the compartment 20 and the compartment 20 has been reclosed, the consumer may return the product to the seller by mail or courier service.

Referring now to FIGS. 17-20A, another exemplary reclosable bag 10 is shown. In this particular example, the bag opening zone 40 is formed in or on the main bag portion 31 proximate the reclosing flap 30 and further proximate the third side 26. By positioning the bag opening zone 40 further proximate the third side 26, more space in the compartment 20 is available when the consumer returns the product 50 to the compartment 20 through the product retrieval opening 44, which, as explained above, is created by opening the bag opening zone 40. An additional advantage of positioning the bag opening zone 40 further proximate the third side 26 in this example is that the reclosing flap 30 covers the bag opening zone 40 and protects the bag opening zone 40 from being unintentionally opened during transit, thereby preventing loss of the product 50.

Figure 17A:
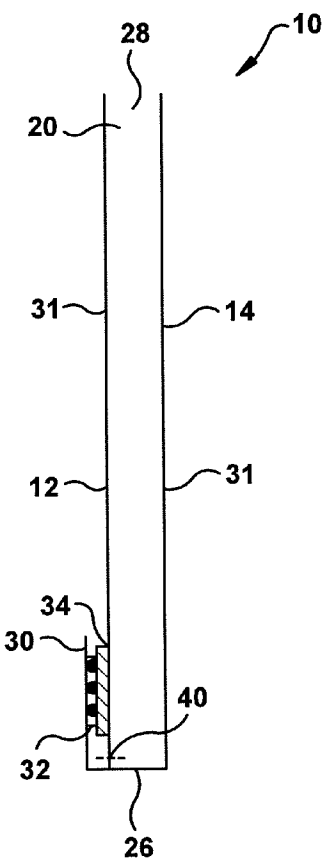
FIG. 17A is a view of the reclosable bag taken along lines 17A-17A in FIG. 17.
Figure 17:
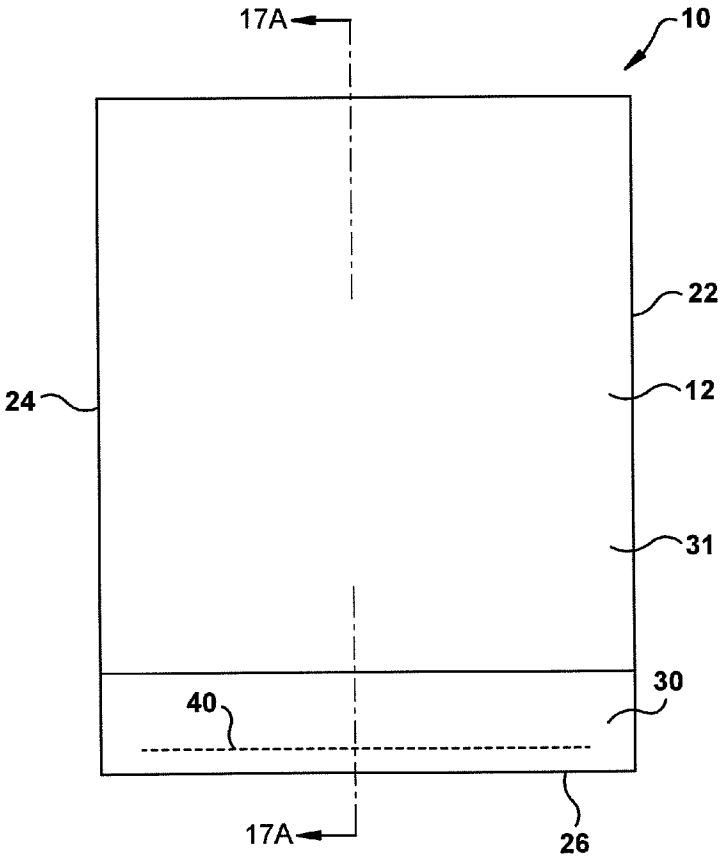
FIG. 17 is a schematic illustration of an exemplary reclosable bag.
Figure 18A:
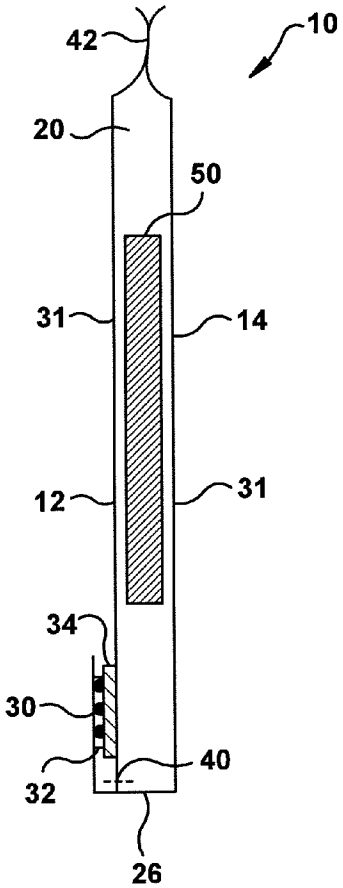
FIG. 18A is a view of the reclosable bag containing a product taken along lines 18A-18A in FIG. 18.
Figure 18:
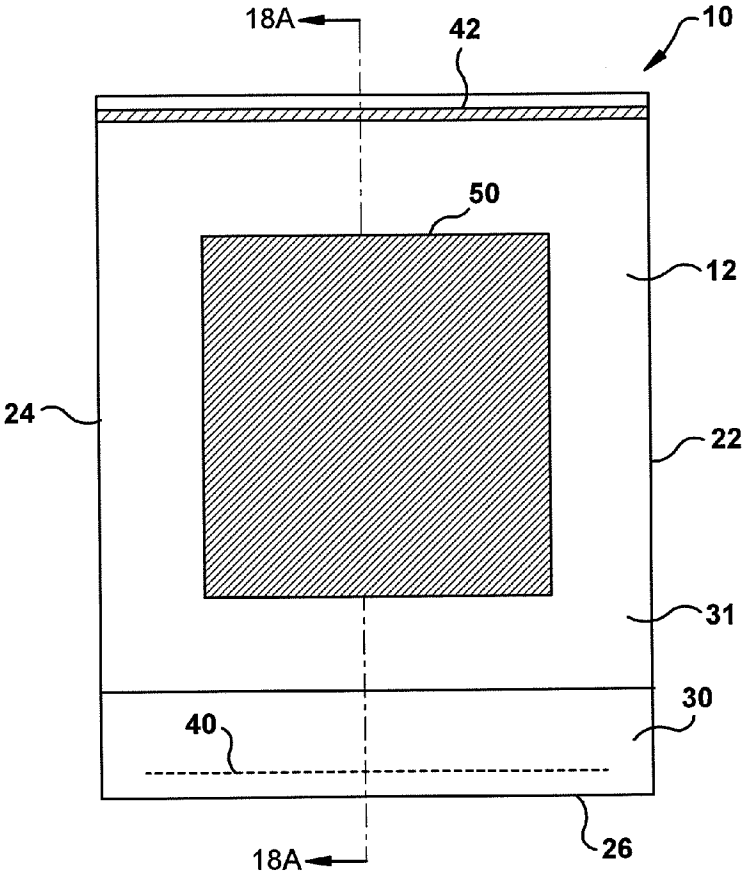
FIG. 18 is a schematic illustration of an exemplary reclosable bag containing a product.

In general, the exemplary reclosable bag 10 illustrated in FIGS. 17-20A is used and functions in a manner similar to the previously described exemplary reclosable bags 10. For example, the product 50 is loaded into the compartment 20 through the product receiving opening 28, seen in FIG. 17A, and then the product receiving opening 28 is sealed, as shown by seal 42 in FIGS. 18 and 18A, to retain the product 50. As seen in FIGS. 18 and 18A, the reclosing flap 30 is in the passive position with the reclosing material 32 releasably adhered to the release material 34.

Figure 19A:
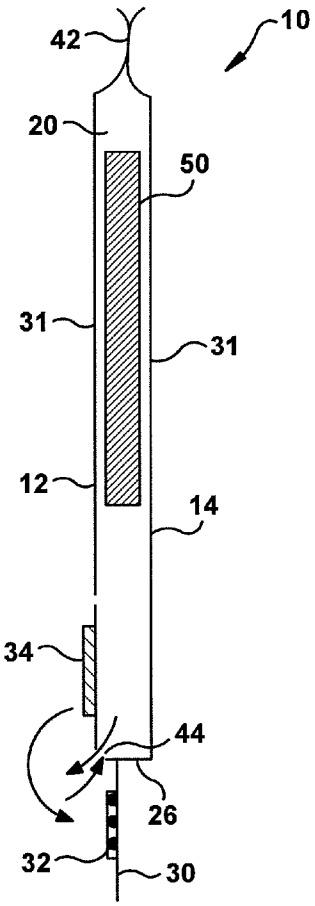
FIG. 19A is a view of the reclosable bag showing the reclosing flap being moved from a passive position to expose the reclosing material taken along lines 19A-19A in FIG. 19.
Figure 19:
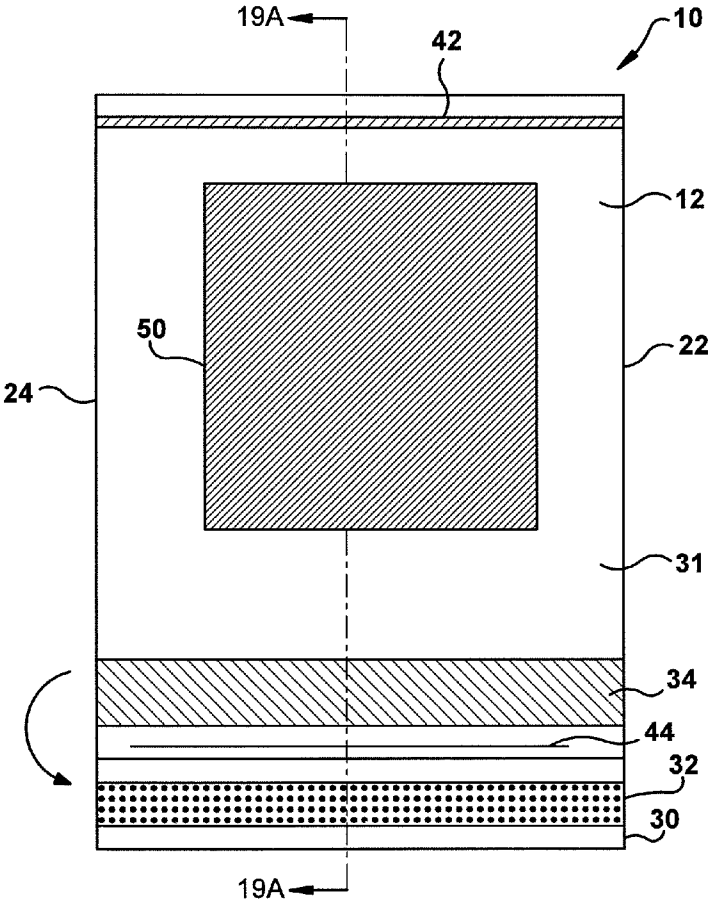
FIG. 19 is a schematic illustration of an exemplary reclosable bag showing a reclosing flap being moved from a passive position to expose a reclosing material.
Figure 20A:
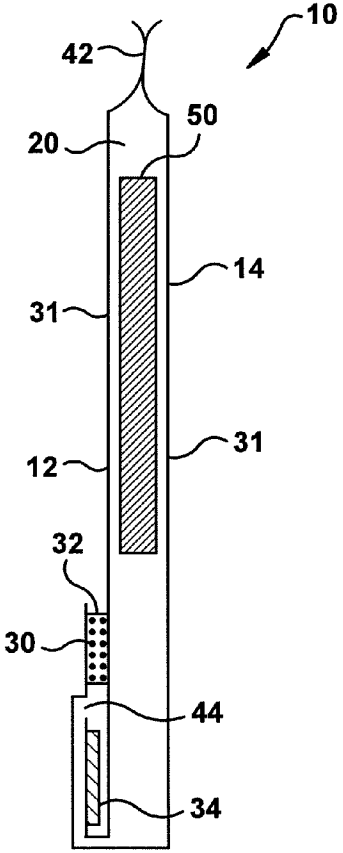
FIG. 20A is a view of the reclosable bag showing the reclosing flap in the active position and the product retrieval opening being covered taken along lines 20A-20A in FIG. 20.
Figure 20:
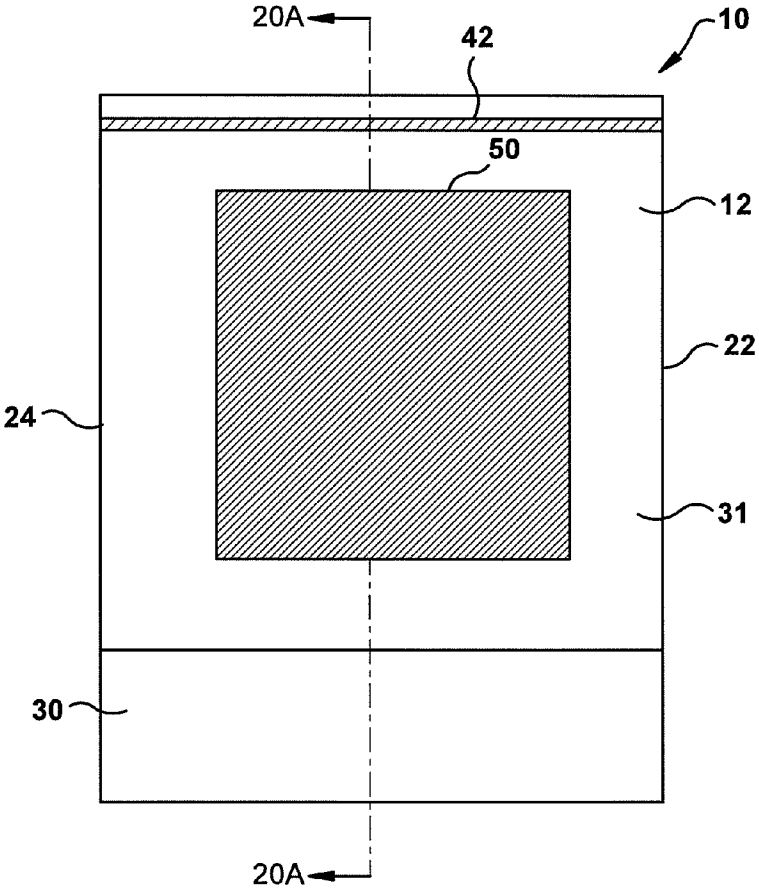
FIG. 20 is a schematic illustration of an exemplary reclosable bag showing a reclosing flap in an active position and a product retrieval opening being covered.

As indicated by the directional arrow in FIGS. 19 and 19A, the reclosing flap 30 is movable from the passive position by pulling on the reclosing flap 30 to separate the reclosing material 32 from the release material 34. When the reclosing flap 30 is moved from the passive position, the reclosing material 32 is exposed and the consumer can access the bag opening zone 40. The product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44. When the product 50 is returned to the compartment 20 the reclosing flap 30 may be moved to the active position where the reclosing material 32 is brought into contact with and adheres to an outer surface of the main bag portion 31, as illustrated in FIG. 20A. After the reclosing flap 30 is moved to the active position, the product retrieval opening 44 is covered to reclose the compartment 20 with the product 50 retained therein, as seen in FIGS. 20 and 20A. When the product 50 is within the compartment 20 and the compartment 20 has been reclosed, the consumer may return the product to the seller by mail or courier service.

Figure 21A:
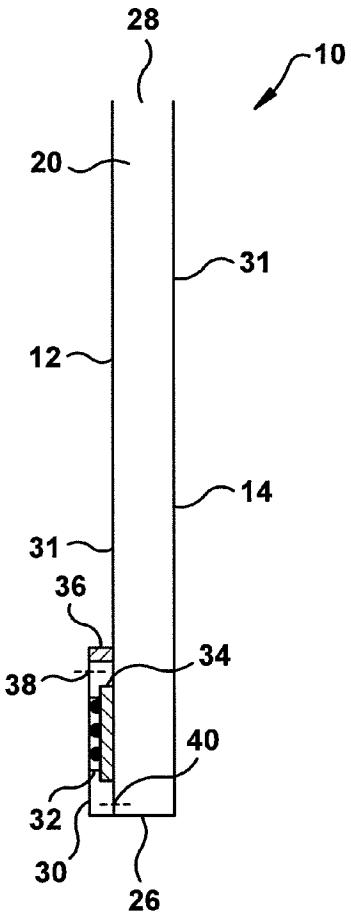
FIG. 21A is a view of the reclosable bag with a reclosing flap sealed to a main bag portion of the bag taken along lines 21A-21A in FIG. 21.
Figure 21:
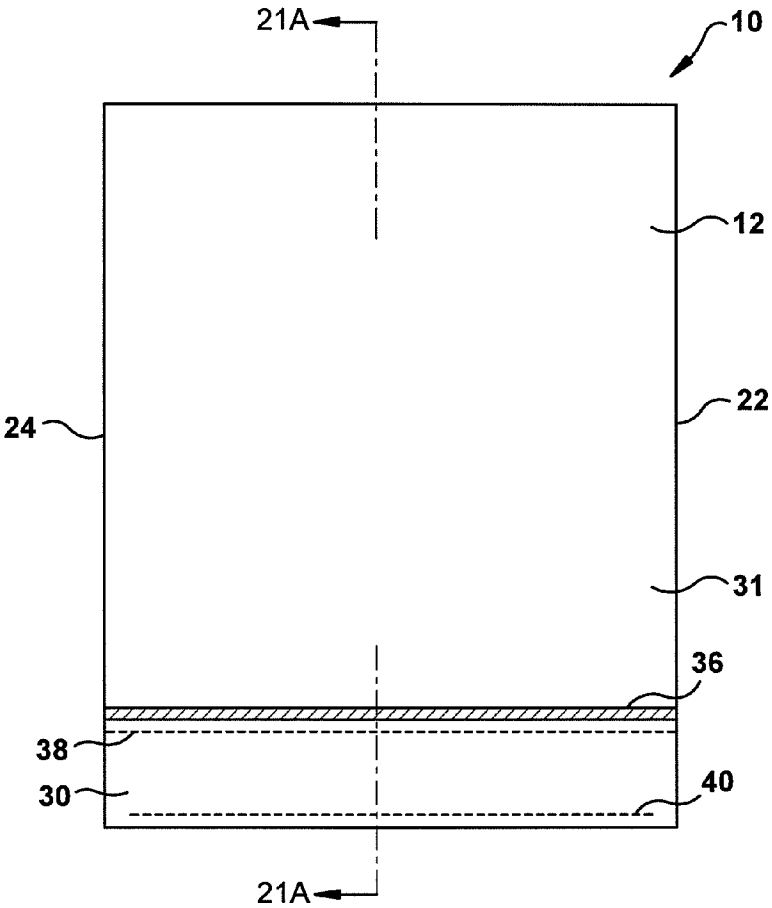
FIG. 21 is a schematic illustration of an exemplary reclosable bag with a reclosing flap sealed to a main bag portion of the bag.

Referring now to FIGS. 21-24A, an additional exemplary reclosable bag 10 is illustrated. In this example, the bag opening zone 40 is formed in or on the main bag portion 31 proximate the reclosing flap 30 and further proximate the third side 26. In addition, in this example, a portion of the reclosing flap 30 may be sealed to the first ply 12, as seen in FIG. 21A, and/or the second ply 14, as indicated by reclosing flap seal 36. In certain other embodiments, a portion of the reclosing flap 30 may be sealed to another portion of the reclosing flap 30. Again, by positioning the bag opening zone 40 further proximate the third side 26, more space in the compartment 20 is available when the consumer returns the product 50 to the compartment 20 through the product retrieval opening 44, which is created by opening the bag opening zone 40. An additional advantage of positioning the bag opening zone 40 further proximate the third side 26 and sealing a portion of the reclosing flap 30 to the first ply 12 and/or the second ply 14 in this example is that the reclosing flap 30 covers the bag opening zone 40 and protects the bag opening zone 40 from being unintentionally opened during transit, thereby preventing loss of the product 50. Moreover, by sealing a portion of the reclosing flap 30 to the first ply 12 and/or the second ply 14, the reclosing flap 30 is prevented from unintentionally moving from the passive position during transit so that the reclosing material 32 is not unintentionally exposed.

With continued reference to FIGS. 21-24A, in this example the reclosing flap 30 is formed with a line or area of reduced strength 38 to permit separation of a portion of the reclosing flap 30 from the main bag portion 31, such as the first ply 12 and/or the second ply 14. As previously discussed, the line or area of reduced strength 38 may be a line or lines of perforations, a score line or lines, or other configurations that promote separation that are known to those of skill in the art.

Figure 22A:
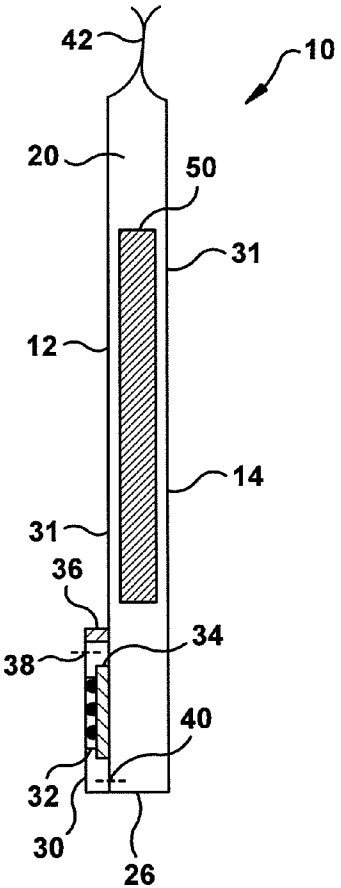
FIG. 22A is a view of the reclosable bag containing a product showing a reclosing flap sealed to a main bag portion of the bag taken along line 22A-22A in FIG. 22.
Figure 22:
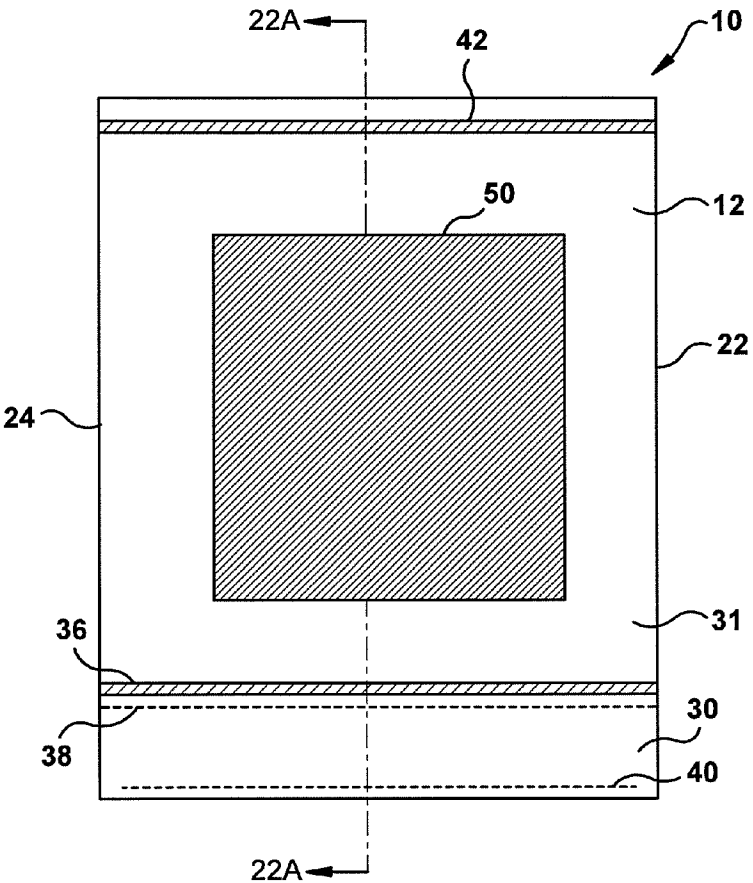
FIG. 22 is a schematic illustration of an exemplary reclosable bag containing a product.

Generally, the exemplary reclosable bag 10 illustrated in FIGS. 21-24A is used and functions in a manner similar to the previously described exemplary reclosable bags 10. For example, the product 50 is loaded into the compartment 20 through the product receiving opening 28, seen in FIG. 21A, and then the product receiving opening 28 is sealed, as shown by seal 42 in FIGS. 22 and 22A, to retain the product 50. As seen in FIGS. 22 and 22A, the reclosing flap 30 is in the passive position with the reclosing material 32 releasably adhered to the release material 34.

Figure 23A:
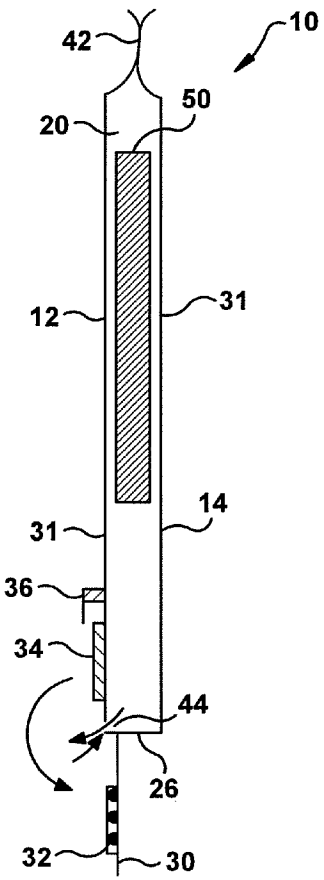
FIG. 23A is a view of the reclosable bag showing the reclosing flap being moved from a passive position to expose the reclosing material taken along lines 23A-23A in FIG. 23.
Figure 23:
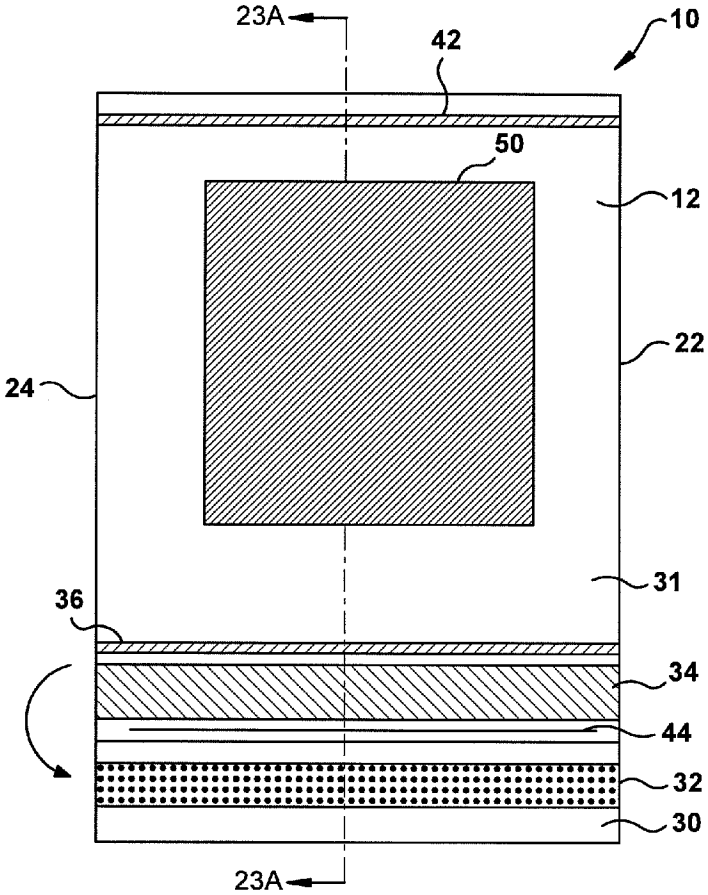
FIG. 23 is a schematic illustration of an exemplary reclosable bag showing a reclosing flap being moved from a passive position to expose a reclosing material.
Figure 24A:
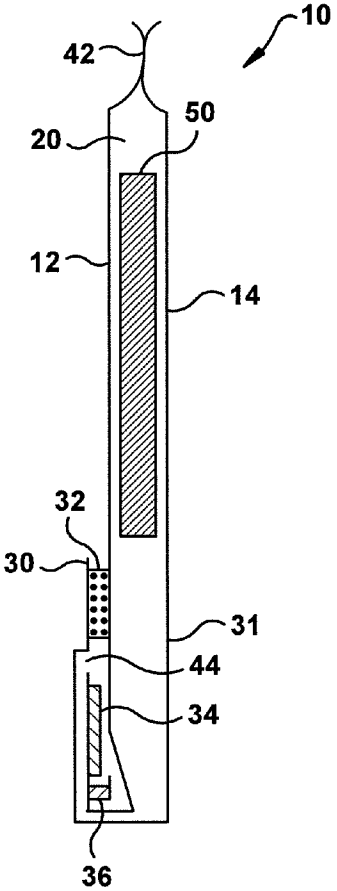
FIG. 24A is a view of the reclosable bag showing the reclosing flap in the active position and the product retrieval opening being covered taken along lines 24A-24A in FIG. 24.
Figure 24:
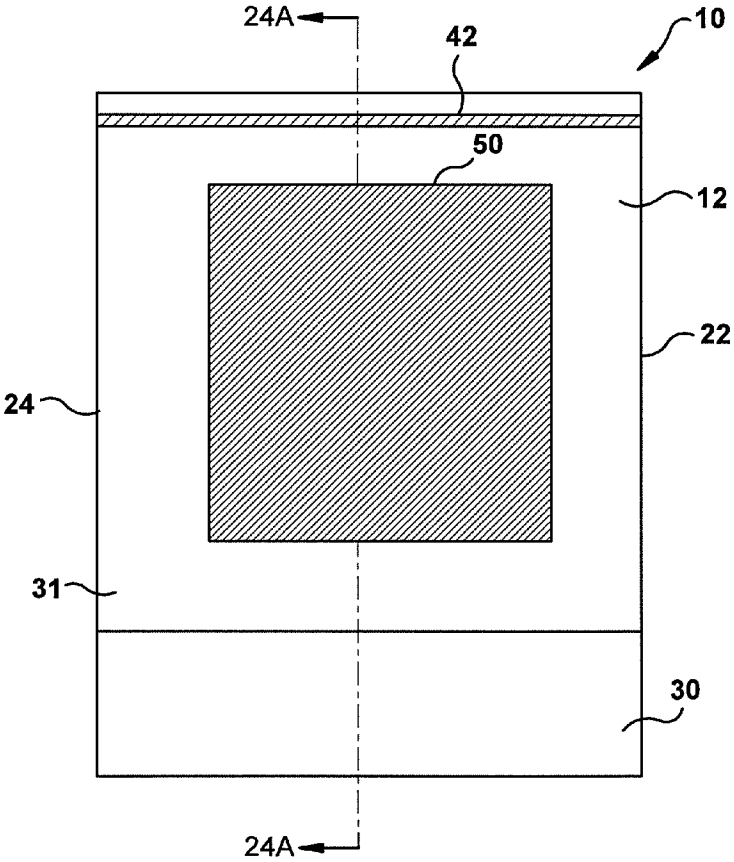
FIG. 24 is a schematic illustration of an exemplary reclosable bag showing a reclosing flap in an active position and a product retrieval opening being covered.

As indicated by the directional arrow in FIGS. 23 and 23A, the reclosing flap 30 is movable from the passive position by: first, breaking the line of reduced strength 38 to separate the reclosing flap 30 from the main bag portion 31; and next, pulling on the reclosing flap 30 to separate the reclosing material 32 from the release material 34. When the reclosing flap 30 is moved from the passive position, the reclosing material 32 is exposed and the consumer can access the bag opening zone 40. The product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44. When the product 50 is returned to the compartment 20 the reclosing flap 30 may be moved to the active position where the reclosing material 32 is brought into contact with and adheres to an outer surface of the main bag portion 31, as illustrated in FIG. 24A. After the reclosing flap 30 is moved to the active position, the product retrieval opening 44 is covered to reclose the compartment 20 with the product 50 retained therein, as seen in FIGS. 24 and 24A. When the product 50 is within the compartment 20 and the compartment 20 has been reclosed, the consumer may return the product to the seller by mail or courier service.

Figure 25A:
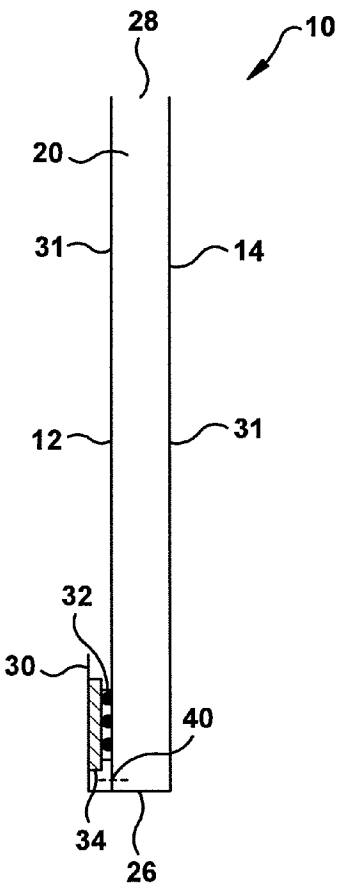
FIG. 25A is a view of the reclosable bag taken along lines 25A-25A in FIG. 25.
Figure 25:
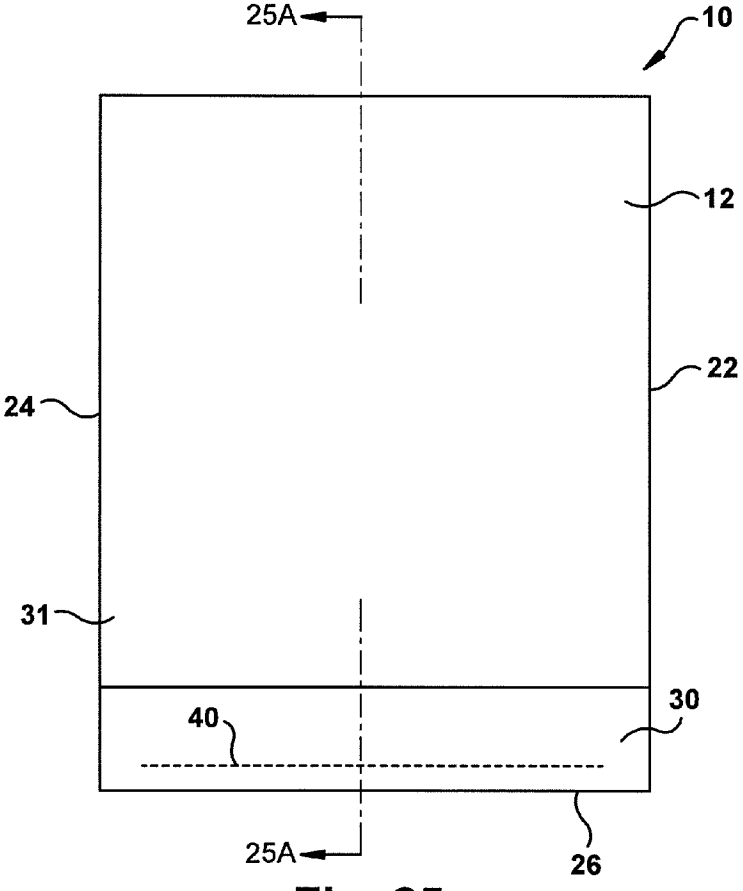
FIG. 25 is a schematic illustration of an exemplary reclosable bag.

An additional exemplary reclosable bag 10 is illustrated in FIGS. 25-28A. In this example, the bag opening zone 40 is formed in or on the main bag portion 31 proximate the reclosing flap 30 and further proximate the third side 26. In addition, in this example, the reclosing material 32 is applied to the main bag portion 31 and the release material 34 is applied to the reclosing flap 30, as seen in FIG. 25A. As previously discussed, by positioning the bag opening zone 40 further proximate the third side 26, more space in the compartment 20 is available when the consumer returns the product 50 to the compartment 20 through the product retrieval opening 44. Moreover, when the bag opening zone 40 is positioned further proximate the third side 26, the reclosing flap 30 covers the bag opening zone 40 and protects the bag opening zone 40 from being unintentionally opened during transit, thereby preventing loss of the product 50.

Figure 26A:
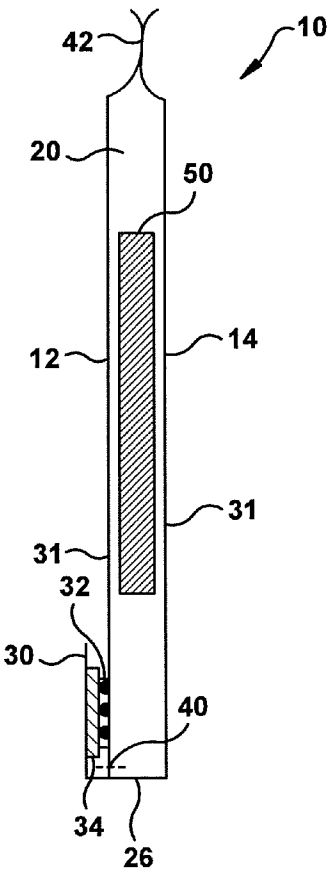
FIG. 26A is a view of the reclosable bag containing a product taken along lines 26A-26A in FIG. 26.
Figure 26:
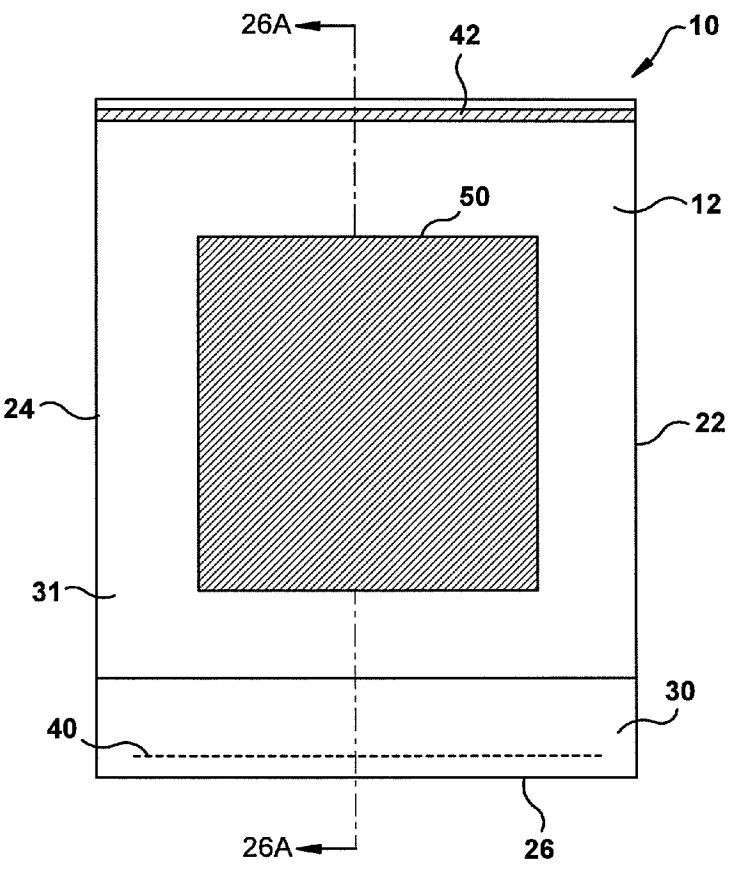
FIG. 26 is a schematic illustration of an exemplary reclosable bag containing a product.

The exemplary reclosable bag 10 illustrated in FIGS. 25-28A is used and functions in a manner similar to the previously described exemplary reclosable bags 10. For example, the product 50 is loaded into the compartment 20 through the product receiving opening 28, seen in FIG. 25A, and then the product receiving opening 28 is sealed, as shown by seal 42 in FIGS. 26 and 26A, to retain the product 50. As seen in FIGS. 26 and 26A, the reclosing flap 30 is in the passive position with the reclosing material 32 releasably adhered to the release material 34.

Figure 27A:
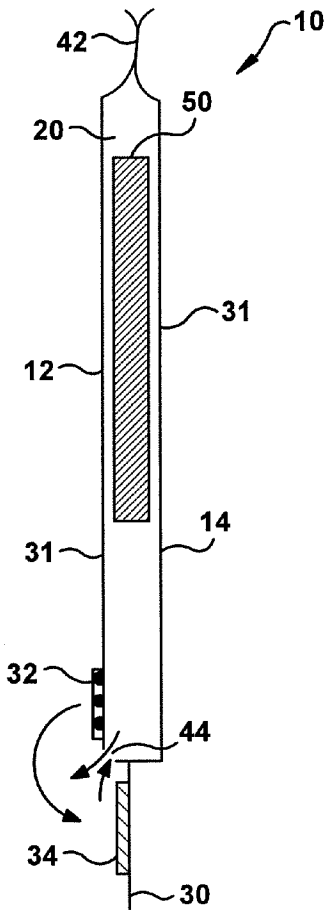
FIG. 27A is a view of the reclosable bag showing the reclosing flap being moved from a passive position to expose the reclosing material taken along lines 27A-27A in FIG. 27.
Figure 27:
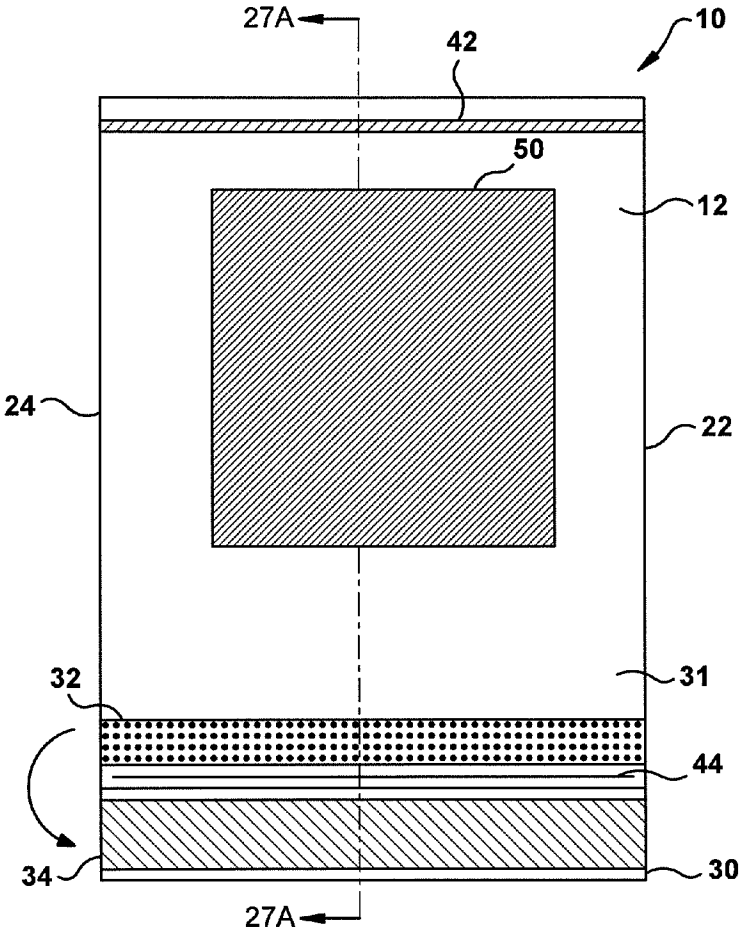
FIG. 27 is a schematic illustration of an exemplary reclosable bag showing a reclosing flap being moved from a passive position to expose a reclosing material.
Figure 28A:
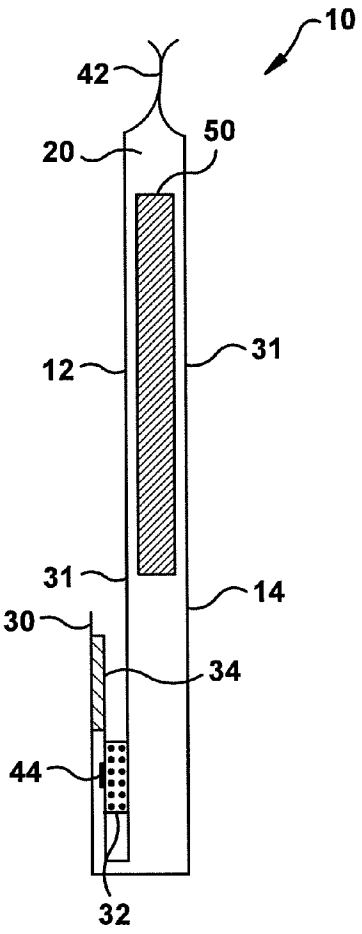
FIG. 28A is a view of the reclosable bag showing the reclosing flap in the active position and the product retrieval opening being covered taken along lines 28A-28A in FIG. 28.
Figure 28:
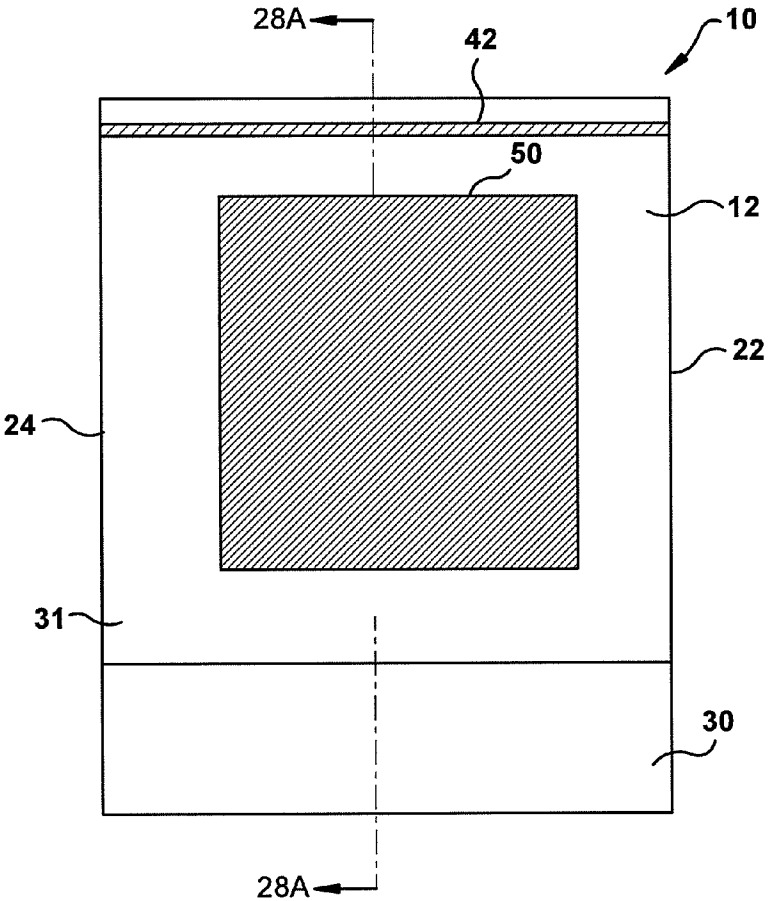
FIG. 28 is a schematic illustration of an exemplary reclosable bag showing a reclosing flap in an active position and a product retrieval opening being covered.

As indicated by the directional arrow in FIGS. 27 and 27A, the reclosing flap 30 is movable from the passive position by pulling on the reclosing flap 30 to separate the reclosing material 32 and the release material 34. When the reclosing flap 30 is moved from the passive position, the reclosing material 32 is exposed and the consumer can access the bag opening zone 40. The product 50 may be removed from the compartment 20 by opening the bag opening zone 40 to create the product retrieval opening 44 to permit retrieval of the product 50 from the compartment 20. After retrieving and inspecting the product 50, the consumer may return the product 50 to the compartment 20 through the product retrieval opening 44. When the product 50 is returned to the compartment 20 the reclosing flap 30 may be moved to the active position where the reclosing material 32 is brought into contact with and adheres to another portion of the bag 10, such as the main bag portion 31 and/or the reclosing flap 30, as illustrated in FIG. 28A. After the reclosing flap 30 is moved to the active position, the product retrieval opening 44 is covered to reclose the compartment 20 with the product 50 retained therein, as seen in FIGS. 28 and 28A. When the product 50 is within the compartment 20 and the compartment 20 has been reclosed, the consumer may return the product to the seller by mail or courier service.

Figure 29:
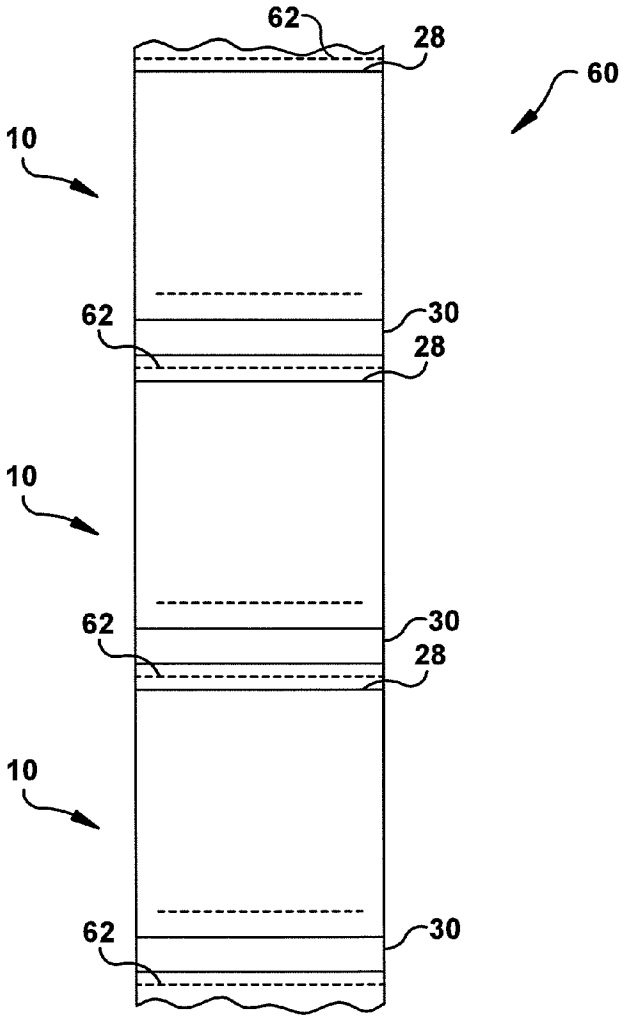
FIG. 29 is a schematic illustration of an exemplary elongated web of preformed interconnected reclosable bags.
Figure 30:
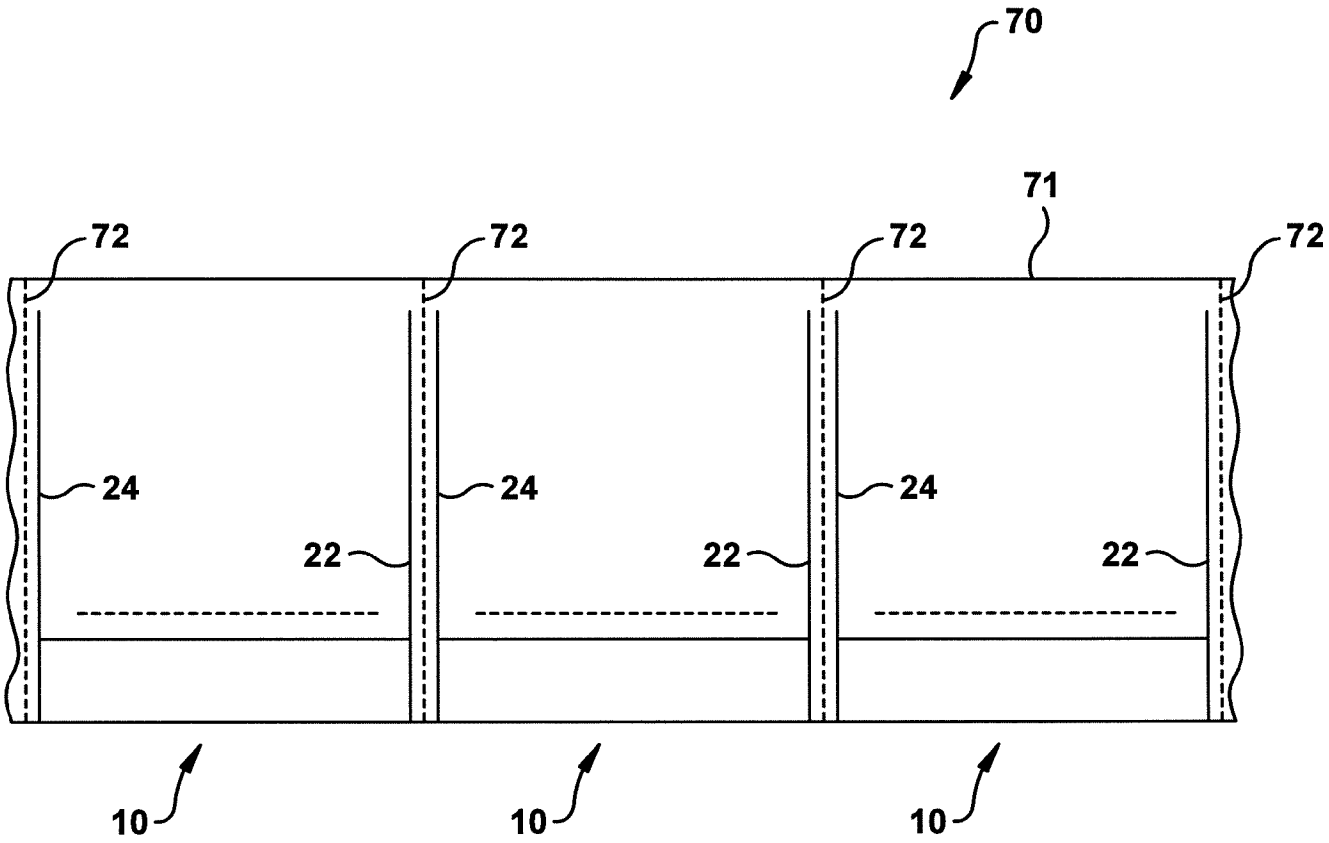
FIG. 30 is a schematic illustration of an exemplary elongated web of preformed interconnected reclosable bags.

Referring now to FIGS. 29 and 30, exemplary embodiments of a web 60, 70 of preformed reclosable bags 10 are shown. The reclosable bags 10 illustrated by FIGS. 29 and 30 may be made in accordance with any of the embodiments disclosed above. Further, the reclosable bags 10 illustrated by FIGS. 29 and 30 may include any combination or subcombination of the features of the bags 10 disclosed above. In the example shown in FIG. 29, the web 60 of preformed reclosable bags 10 is configured such that the reclosing flap 30 of a first reclosable bag 10 is adjacent to the product receiving opening 28 of a second reclosable bag 10 (i.e., the preformed reclosable bags 10 are connected top-to-bottom). As seen in FIG. 29, the preformed reclosable bags 10 are connected to one another by, and are configured to be separated from one another along, a line of weakness 62, such as a line of perforations. The web 60 may be supplied on a roll or in a folded state for use with a packaging machine that loads a product 50 into each preformed reclosable bag 10, seals the product 50 in the bag 10, and optionally separates the loaded bag 10 from the remainder of the web 60. An exemplary packaging machine for loading a product 50 into each preformed reclosable bag 10 of the web 60 is disclosed in U.S. Pat. Nos. 7,654,064 and 8,069,635 to Riccardi et al., which are incorporated herein by reference in their entirety.

As seen in the example shown in FIG. 30, the web 70 of preformed reclosable bags 10 is configured such that the first side 22 of a first reclosable bag 10 is adjacent to the second side of a second reclosable bag 10 (i.e., the preformed reclosable bags 10 are connected side-to-side). The web 70 of preformed reclosable bags 10 are connected to one another by, and are configured to be separated from one another along, a line of weakness 72, such as a line of perforations. As seen in FIG. 30, each line of weakness 72 extends the entire width of the web 70 to promote complete separation of each preformed reclosable bag 10. The web 70 may be supplied on a roll or in a folded state for use with a packaging machine that loads a product 50 into each preformed reclosable bag 10. In certain embodiments, the sealed first side 22 and sealed second side 24 do not extend the entire width of the web 70. The plies 12,14 may be sealed or otherwise connected at a top portion 71 of the web 70. A packaging machine may include a slitter that splits the top portion 71 of the web 70 to create a product receiving opening 28 to facilitate the loading of a product 50. An exemplary packaging machine for loading a product 50 into each preformed reclosable bag 10 of the web 70 is disclosed in U.S. Pat. No. 5,743,070 to Lerner et al., which is incorporated herein by reference in its entirety.

In an exemplary embodiment, a method of forming a reclosable bag 10 containing a product 50 includes joining a first ply 12 to a second ply 14. In certain embodiments, the first and second plies 12,14 may be two separate plies, or a single ply that is folded. The joined first ply 12 and second ply 14 define a main bag portion 31 having a compartment 20 including a first side 22, a second side 24, a third side 26 that extends between the first side 22 and the second side 24, and a product receiving opening 28. A reclosing flap 30 is connected to or on the main bag portion 31, such as at or on the third side 26, and is spaced apart from the product receiving opening 28. As previously mentioned, the first ply 12 and the second ply 14 may be joined utilizing various techniques known to those of skill in the art including, but not limited to, heat sealing, ultrasonic welding, gluing with adhesives, etc. In certain embodiments, a flattened tube of material may be utilized instead of a first ply 12 and a second ply 14, wherein one of the open ends of the flattened tube may be sealed prior to loading a product 50 therein.

In another step of the exemplary method, a bag opening zone 40 is formed in or on the main bag portion 31 proximate the reclosing flap 30. As discussed above, the bag opening zone 40 may be defined by one or more lines or areas of weakness, an indicia that indicates where the bag 10 should be cut to open the bag 10, an adhesive, an openable connection, etc.

In yet another step of the exemplary method, a reclosing material 32 is applied to the bag 10. In certain embodiments, the reclosing material 32 may be printed directly onto a surface of the bag 10, such as a surface of the main bag portion 31 or a surface of the reclosing flap 30. Yet, in other embodiments, the reclosing material 32 may be configured as a double-sided adhesive that is automatically or manually pressed onto a surface of the bag 10, such as a surface of the main bag portion 31 or a surface of the reclosing flap 30.

In an additional step of the exemplary method, a release material 34 is applied to the bag 10. In certain embodiments, the release material 34 may be printed directly onto a surface of the bag 10, such as a surface of the main bag portion 31 or a surface of the reclosing flap 30. After the reclosing material 32 is applied onto a surface of the bag 10 and the release material 34 is applied onto a surface of the bag 10, the reclosing flap 30 is moved to bring the reclosing material 32 into contact with the release material 34 to releasably adhere the reclosing material 32 to the release material 34.

After the reclosable bag 10 has been formed, a product 50 is loaded into the compartment 20 through the product receiving opening 28. When the product 50 has been loaded into the compartment 20, the product receiving opening 28 is sealed to retain the product 50 therein. As previously described, the product receiving opening 28 may be sealed utilizing various techniques known to those of skill in the art including, but not limited to, heat sealing, ultrasonic welding, gluing with an adhesive, etc.

As will be appreciated, the arrangement of the reclosing material 32 and the release material 34 on the bag 10 eliminate the need for the relatively costly release strips utilized in conventional reclosable bags. Moreover, there is no waste material generated when the compartment 20 is accessed to retrieve the product 50 or when the consumer returns the product 50 to the compartment 20 and recloses the compartment 20 to return the product 50 to the seller.

In certain embodiments, the exemplary method of forming a reclosable bag 10 containing a product 50 may include the additional steps of: forming a line or area of reduced strength 38 in the reclosing flap 30, and sealing a portion of the reclosing flap 30 to the first ply 12 and/or the second ply 14, or another portion of the reclosing flap 30. The line or area of reduced strength 38 may be a line or lines of perforations, a score line or lines, or other configurations that promote separation that are known to those of skill in the art. As mentioned above, by sealing a portion of the reclosing flap 30 to the first ply 12 and/or the second ply 14, or another portion of the reclosing flap 30, the reclosing flap 30 is prevented from moving from the passive position during transit so that the reclosing material 32 is not unintentionally exposed. Again, the seal may be achieved via various techniques including, but not limited to, heat sealing, ultrasonic welding, gluing, etc. By forming a line or area of reduced strength 38 in the reclosing flap 30, a consumer may easily separate the reclosing flap 30 from the main bag portion 31 or another portion of the reclosing flap 30 to move the reclosing flap 30 from the passive position to the active position.

In an exemplary embodiment, a method of reclosing a product 50 in a bag includes providing a bag for reclosing a product 50 therein. In the example, the bag includes a first ply 12 joined to a second ply 14. In certain embodiments, the first and second plies 12,14 may be two separate plies, or a single ply that is folded. The joined first ply 12 and second ply 14 define a main bag portion 31 having a compartment 20 including a first side 22, a second side 24, a third side 26 that extends between the first side 22 and the second side 24, and a product receiving opening 28. A reclosing flap 30 is connected to or on the main bag portion 31, such as at or on the third side 26, and is spaced apart from the product receiving opening 28. As previously discussed, a reclosing material 32 is applied to the bag 10 and a release material 34 is applied to the bag 10. The reclosing material 32 and the release material 34 are arranged such that the reclosing material 32 releasably adheres to the release material 34. The bag also includes a bag opening zone 40 formed in or on the main bag portion 31 proximate the reclosing flap 30.

A next step in the exemplary method includes loading a product 50 into the compartment 20 through the product receiving opening 28. The loading step may be performed manually or via an automated process. After the product 50 is loaded into the compartment 20, the next step in the method includes sealing the first ply 12 to the second ply 14 to close the product receiving opening 28. As previously mentioned, the sealing step may be performed utilizing various techniques known to those of skill in the art including, but not limited to, heat sealing, ultrasonic welding, gluing, etc.

In a further step of the exemplary method, the bag opening zone 40 is broken or otherwise opened to create a product retrieval opening 44 to permit retrieval of the product 50 from the compartment 20. After the product 50 is removed from the compartment 20, the consumer may inspect the product 50 and may decide to return the product 50 to the seller for a variety of reasons. Thus, in a further step of the method, the product 50 is returned to the compartment 20 through the product retrieval opening 44. After the product 50 is returned to the compartment 20, the reclosing flap 30 may be moved to separate the reclosing material 32 from the release material 34 to expose the reclosing material 32. Next, the reclosing flap 30 may be moved such that the reclosing material 32 adheres to a portion of the bag 10 and the product retrieval opening 44 is covered to reclose the product 50 within the compartment 20.

Although the methods disclosed herein have been described with a particular order of steps, any one or more of the steps may be omitted and/or the order of the steps may be changed without departing from the spirit and the scope of the disclosed methods. Moreover, any one or more of the steps may be carried out manually or via an automated process utilizing various packaging machines and equipment known to those of skill in the art.

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

What is claimed is:

1. A reclosable bag comprising:

a first ply and a second ply, the first ply joined to the second ply to define a main bag portion having a compartment including a first side, a second side, a third side that extends between the first side and the second side, and a product receiving opening that is configured to be hermetically sealed;

a reclosing flap connected to the main bag portion at a first location spaced apart from the product receiving opening, wherein the reclosing flap is configured to move between a passive folded position and an active position;

a reclosing material and a release material, wherein the reclosing material and the release material are applied to the bag such that when the reclosing flap is in the passive folded position the reclosing material is releasably adhered to the release material, and when the reclosing flap is in the active position the reclosing material is adhered to a portion of the bag where release material is not applied;

a bag opening zone formed in the main bag portion between the product receiving opening and the first location, wherein the bag opening zone is configured to be opened to create a product retrieval opening to permit retrieval of a product from the compartment;

wherein the product retrieval opening is configured to allow the product to be returned to the compartment through the product retrieval opening, wherein the reclosing flap is movable from the passive folded position to the active position such that the reclosing material adheres to a portion of the bag and the product retrieval opening is covered to reclose the compartment; and wherein the bag opening zone is between the reclosing material and the release material.

2. The reclosable bag of claim 1, wherein a portion of the reclosing flap is sealed to one of the first ply, the second ply, or another portion of the reclosing flap, and the reclosing flap having a line of reduced strength to permit separation of the reclosing flap from one of the first ply, the second ply, or another portion of the reclosing flap.

3. The reclosable bag of claim 2, wherein the reclosing flap is sealed to both the first ply and the second ply.

4. The reclosable bag of claim 1, wherein the reclosing material is a pressure sensitive adhesive selected from the group consisting of an acrylic based adhesive, a methacrylate based adhesive, a polyurethane based adhesive, a rubber based adhesive, a styrene copolymer based adhesive, a silicone based adhesive, and combinations thereof.

5. The reclosable bag of claim 1, wherein the release material is a chemical release material selected from the group consisting of polyacrylates, carbamates, polyolefins, fluorocarbons, chromium stearate complexes, silicones, and combinations thereof.

6. The reclosable bag of claim 1, wherein the first ply and the second ply comprise a material selected from the group consisting of polyethylene, cellophane, vinyl films, pliofilms, cellulose acetate film, polystyrene, polypropylene, and combinations thereof.

7. The reclosable bag of claim 1, wherein the reclosing flap extends from the third side.

8. A reclosable bag comprising:

a first ply and a second ply, the first ply joined to the second ply to define a main bag portion having a compartment including a first side, a second side, a third side that extends between the first side and the second side, and a product receiving opening that is configured to be hermetically sealed;

a reclosing flap connected to the main bag portion at a first location spaced apart from the product receiving opening, wherein the reclosing flap is configured to move between a passive folded position and an active position;

a reclosing material and a release material, wherein the reclosing material and the release material are applied to the bag such that when the reclosing flap is in the passive folded position the reclosing material is releasably adhered to the release material, and when the reclosing flap is in the active position the reclosing material is adhered to a portion of the bag where release material is not applied;

a bag opening zone formed in the main bag portion between the product receiving opening and the first location, wherein the bag opening zone is configured to be opened to create a product retrieval opening to permit retrieval of a product from the compartment;

wherein the product retrieval opening is configured to allow the product to be returned to the compartment through the product retrieval opening, wherein the reclosing flap is movable from the passive folded position to the active position such that the reclosing material adheres to a portion of the bag and the product retrieval opening is covered to reclose the compartment; and wherein the release material is applied to the reclosing flap and the reclosing material is applied to the main bag portion at a second location, and wherein in the reclosing flap is moved to the active position, the reclosing material adheres to the main bag portion at a third location that is different than the second location.

9. The reclosable bag of claim 8, wherein a portion of the reclosing flap is sealed to one of the first ply, the second ply, or another portion of the reclosing flap, and the reclosing flap having a line of reduced strength to permit separation of the reclosing flap from one of the first ply, the second ply, or another portion of the reclosing flap.

10. The reclosable bag of claim 9, wherein the reclosing flap is sealed to both the first ply and the second ply.

11. The reclosable bag of claim 8, wherein the reclosing material is a pressure sensitive adhesive selected from the group consisting of an acrylic based adhesive, a methacrylate based adhesive, a polyurethane based adhesive, a rubber based adhesive, a styrene copolymer based adhesive, a silicone based adhesive, and combinations thereof.

12. The reclosable bag of claim 8, wherein the release material is a chemical release material selected from the group consisting of polyacrylates, carbamates, polyolefins, fluorocarbons, chromium stearate complexes, silicones, and combinations thereof.

13. The reclosable bag of claim 8, wherein the first ply and the second ply comprise a material selected from the group consisting of polyethylene, cellophane, vinyl films, pliofilms, cellulose acetate film, polystyrene, polypropylene, and combinations thereof.

14. The reclosable bag of claim 8, wherein the reclosing flap extends from the third side.

15. A reclosable bag comprising:

a first ply and a second ply, the first ply joined to the second ply to define a main bag portion having a compartment and a product receiving opening that is configured to be hermetically sealed;

a reclosing flap connected to the main bag portion at a first location spaced apart from the product receiving opening, wherein a distal portion of the reclosing flap is sealed to one of the first ply, the second ply, or another portion of the reclosing flap, and a line of reduced strength is formed in the reclosing flap between the distal portion of the reclosing flap and the portion of the reclosing flap connected to the main bag portion at the first location, and wherein the reclosing flap is configured to move between a passive folded position and an active position;

a reclosing material and a release material, wherein the reclosing material and the release material are applied to the bag such that when the reclosing flap is in the passive folded position the reclosing material is releasably adhered to the release material, and when the reclosing flap is in the active position the reclosing material is adhered to a portion of the bag where release material is not applied;

a bag opening zone formed in the main bag portion proximate the reclosing flap, wherein the bag opening zone is configured to be opened to create a product retrieval opening to permit retrieval of a product from the compartment, wherein the product retrieval opening is a different opening than the product receiving opening;

wherein the product retrieval opening is configured to allow the product to be returned to the compartment through the product retrieval opening, and the line of reduced strength is configured to be broken to allow the reclosing flap to be moved from the passive folded position to the active position such that the reclosing material adheres to a portion of the bag where release material is not applied and the product retrieval opening is covered to reclose the compartment; and wherein the distal portion of the reclosing flap is sealed to another portion of the reclosing flap.

16. The reclosable bag of claim 15, wherein the reclosing material is a pressure sensitive adhesive selected from the group consisting of an acrylic based adhesive, a methacrylate based adhesive, a polyurethane based adhesive, a rubber based adhesive, a styrene copolymer based adhesive, a silicone based adhesive, and combinations thereof.

17. The reclosable bag of claim 15, wherein the release material is a chemical release material selected from the group consisting of polyacrylates, carbamates, polyolefins, fluorocarbons, chromium stearate complexes, silicones, and combinations thereof.

18. The reclosable bag of claim 15, wherein the first ply and the second ply comprise a material selected from the group consisting of polyethylene, cellophane, vinyl films, pliofilms, cellulose acetate film, polystyrene, polypropylene, and combinations thereof.

19. The reclosable bag of claim 15, wherein the release material is applied to the reclosing flap at a second location and the reclosing material is applied to the reclosing flap at a third location different than the second location.

20. The reclosable bag of claim 15, wherein the bag opening zone is between the product receiving opening and both the reclosing material and the release material.

* * * * *